US009405269B2

(12) United States Patent
Fujita et al.

(10) Patent No.: US 9,405,269 B2
(45) Date of Patent: Aug. 2, 2016

(54) IMAGE FORMING APPARATUS WITH A GUIDE MEMBER FOR A TRANSFER BELT

(71) Applicants: Junpei Fujita, Kanagawa (JP); Kenji Sugiura, Kanagawa (JP); Seiichi Kogure, Kanagawa (JP); Junichi Ichikawa, Kanagawa (JP); Kazuki Yogosawa, Tokyo (JP)

(72) Inventors: Junpei Fujita, Kanagawa (JP); Kenji Sugiura, Kanagawa (JP); Seiichi Kogure, Kanagawa (JP); Junichi Ichikawa, Kanagawa (JP); Kazuki Yogosawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/462,815

(22) Filed: Aug. 19, 2014

(65) Prior Publication Data

US 2015/0055981 A1 Feb. 26, 2015

(30) Foreign Application Priority Data

Aug. 22, 2013 (JP) ..... 2013-172372
Jun. 26, 2014 (JP) ..... 2014-131946

(51) Int. Cl.
*G03G 15/16* (2006.01)
*G03G 21/16* (2006.01)

(52) U.S. Cl.
CPC ..... *G03G 21/168* (2013.01); *G03G 15/1615* (2013.01)

(58) Field of Classification Search
CPC ..... G03G 21/168; G03G 15/1615
USPC ..... 399/121
See application file for complete search history.

(56) References Cited

U.S. PATENT DOCUMENTS

| | | | | |
|---|---|---|---|---|
| 4,811,839 | A * | 3/1989 | Cornell et al. | 206/303 |
| 5,400,121 | A * | 3/1995 | Foote | 399/116 |
| 5,617,195 | A * | 4/1997 | Torimaru et al. | 399/27 |
| 5,669,054 | A * | 9/1997 | Uchida et al. | 399/313 |
| 6,049,682 | A * | 4/2000 | Goetzke et al. | 399/116 |
| 6,233,415 | B1 * | 5/2001 | Pang | 399/116 |
| 6,328,155 | B1 * | 12/2001 | Omura et al. | 198/813 |
| 6,999,709 | B2 * | 2/2006 | Park | 399/302 |
| 7,313,345 | B2 * | 12/2007 | Inaba et al. | 399/113 |
| 7,680,445 | B2 * | 3/2010 | Kim | 399/302 |
| 7,848,663 | B2 * | 12/2010 | Okano | 399/13 |
| 7,986,903 | B2 * | 7/2011 | Park | 399/121 |
| 8,045,885 | B2 * | 10/2011 | Gunbe | 399/113 |
| 8,146,734 | B2 * | 4/2012 | Shoji | 198/813 |

(Continued)

FOREIGN PATENT DOCUMENTS

| | | |
|---|---|---|
| JP | 5-023347 | 6/1993 |
| JP | 2001-030603 | 2/2001 |

(Continued)

OTHER PUBLICATIONS

U.S. Appl. No. 14/185,242, filed Feb. 20, 2014.

*Primary Examiner* — David Bolduc
(74) *Attorney, Agent, or Firm* — Oblon, McClelland, Maier & Neustadt, L.L.P.

(57) ABSTRACT

An image forming apparatus is provided, including a plurality of rollers; an endless belt mountable to the plurality of rollers from a proximal side of the image forming apparatus in an axial direction of the plurality of rollers; a first side plate to support one end of the plurality of rollers at the proximal side of the image forming apparatus in the axial direction; and a plurality of guide members, disposed at a more proximal side than the first side plate in the axial direction, to guide the belt to be mounted to the plurality of rollers with the guide members contacting the belt.

28 Claims, 23 Drawing Sheets

(56) References Cited

U.S. PATENT DOCUMENTS

| | | | | |
|---|---|---|---|---|
| 2001/0051059 | A1* | 12/2001 | Morikami et al. | 399/121 |
| 2003/0152400 | A1* | 8/2003 | Maier et al. | 399/121 |
| 2003/0231898 | A1* | 12/2003 | Asaoka et al. | 399/116 |
| 2004/0228653 | A1* | 11/2004 | Yoshino | 399/121 |
| 2005/0074259 | A1* | 4/2005 | Tachiki et al. | 399/121 |
| 2005/0084291 | A1* | 4/2005 | Kyung et al. | 399/121 |
| 2005/0129431 | A1* | 6/2005 | Oohara et al. | 399/329 |
| 2006/0072929 | A1* | 4/2006 | Takahashi | 399/13 |
| 2006/0140668 | A1* | 6/2006 | Sato et al. | 399/110 |
| 2006/0210288 | A1* | 9/2006 | Hayashi et al. | 399/33 |
| 2007/0025762 | A1* | 2/2007 | Kato et al. | 399/121 |
| 2007/0048010 | A1* | 3/2007 | Nakano | 399/121 |
| 2007/0147891 | A1* | 6/2007 | Mori | 399/121 |
| 2007/0231001 | A1* | 10/2007 | Kaiho et al. | 399/121 |
| 2007/0231003 | A1* | 10/2007 | Shoji | 399/121 |
| 2009/0057103 | A1* | 3/2009 | Parks | 198/837 |
| 2009/0062047 | A1* | 3/2009 | Parks | 474/111 |
| 2009/0110436 | A1* | 4/2009 | Sugiyama | 399/121 |
| 2009/0154957 | A1* | 6/2009 | Furuya | 399/121 |
| 2009/0226210 | A1* | 9/2009 | Hayakawa et al. | 399/116 |
| 2009/0304426 | A1* | 12/2009 | Nakagaki | 399/400 |
| 2010/0067952 | A1 | 3/2010 | Fujita et al. | |
| 2011/0033202 | A1* | 2/2011 | Imai | 399/111 |
| 2011/0058859 | A1 | 3/2011 | Nakamatsu et al. | |
| 2011/0064487 | A1 | 3/2011 | Ichihashi et al. | |
| 2011/0211855 | A1 | 9/2011 | Kogure et al. | |
| 2011/0280617 | A1* | 11/2011 | Iino et al. | 399/110 |
| 2011/0286759 | A1 | 11/2011 | Ichihashi et al. | |
| 2011/0293312 | A1 | 12/2011 | Mimbu et al. | |
| 2012/0148300 | A1 | 6/2012 | Katoh et al. | |
| 2012/0237260 | A1 | 9/2012 | Sengoku et al. | |
| 2012/0328320 | A1 | 12/2012 | Fujita et al. | |
| 2013/0016989 | A1 | 1/2013 | Fujita et al. | |
| 2013/0108320 | A1* | 5/2013 | Ju et al. | 399/121 |
| 2013/0114982 | A1 | 5/2013 | Ichihashi et al. | |
| 2013/0189002 | A1 | 7/2013 | Ichihashi et al. | |
| 2013/0195506 | A1* | 8/2013 | Yamaguchi | 399/121 |
| 2013/0216260 | A1 | 8/2013 | Kogure et al. | |
| 2013/0322935 | A1 | 12/2013 | Ichihashi et al. | |

FOREIGN PATENT DOCUMENTS

| | | |
|---|---|---|
| JP | 2003-195649 | 7/2003 |
| JP | 2006-215358 | 8/2006 |
| JP | 2012-123233 | 6/2012 |

* cited by examiner $$SF-1 = \frac{(MXLNG)^2}{AREA} \times \frac{\pi}{4} \times 100$$

$$SF-2 = \frac{(PERI)^2}{AREA} \times \frac{1}{4\pi} \times 100$$

IMAGE FORMING APPARATUS WITH A GUIDE MEMBER FOR A TRANSFER BELT

CROSS-REFERENCE TO RELATED APPLICATIONS

The present application claims priority pursuant to 35 U.S.C. §119(a) from Japanese patent application numbers 2013-172372, and 2014-131946, filed on Aug. 22, 2013, and Jun. 26, 2014, respectively, the entire disclosures of which are incorporated by reference herein.

BACKGROUND

1. Technical Field

Exemplary embodiments of the present invention relate to an image forming apparatus including a chassis that houses a transfer unit, the transfer unit including a plurality of rollers that support an endless belt.

2. Background Art

Conventional image forming apparatuses are constructed of a chassis that houses a transfer unit, which includes an endless intermediate transfer belt, and a sheet feed unit including a sheet conveyance belt.

In general, these image forming apparatus include four photoreceptors, each forming a toner image of one of the colors yellow (Y), magenta (M), cyan (C), and black (K), respectively, and a transfer unit configured as a belt unit. The Y-, M-, C-, and K-toner images formed on respective photoreceptors with a known electrophotographic process are then transferred in a superimposed manner onto the intermediate transfer belt of the transfer unit, thereby forming a full color toner image. In operation, the intermediate transfer belt rotates continuously while contacting all four photoreceptors.

The transfer unit switches the endless intermediate transfer belt between a posture in which the intermediate transfer belt is being conveyed during operation and a posture during replacement, or attachment/detachment of the transfer unit. During replacement, the intermediate transfer belt is separated from all four photoreceptors and the transfer unit can be removed from the image forming apparatus.

In the posture in which the transfer unit can be detached (i.e., during maintenance), the transfer unit is drawn to a proximal side from a relatively wide opening formed in a front wall of the chassis of the image forming apparatus, so that necessary maintenance can be performed. After maintenance, the intermediate transfer belt is attached in the unit attachment posture to the chassis from the front opening.

Although various approaches have been attempted, conventional belt units and image forming apparatuses do not disclose a structure capable of preventing the endless belt from contacting neighboring parts when the endless belt is replaced or attached/detached.

SUMMARY

In one embodiment of the disclosure, there is provided an improved image forming apparatus, including a plurality of rollers; an endless belt mountable to the plurality of rollers from a proximal side of the image forming apparatus in an axial direction of the plurality of rollers; a first side plate to support one end of the plurality of rollers at the proximal side of the image forming apparatus in the axial direction; and a plurality of guide members, disposed at a more proximal side than the first side plate in the axial direction, to guide the belt to be mounted to the plurality of rollers with the guide members contacting the belt.

These and other objects, features, and advantages of the present invention will become apparent upon consideration of the following description of preferred embodiments of the present invention when taken in conjunction with the accompanying drawings.

BRIEF DESCRIPTION OF THE DRAWINGS

FIG. 14A shows a perspective partial view, and FIG. 14B illustrates a displacement of a movable guide member;

FIG. 18A shows a first embodiment and FIG. 18B is a second embodiment;

FIGS. 25A and 25B illustrate schematic structures of the guide member used in yet another embodiment of the present invention, in which FIG. 25A shows a first modified embodiment, and FIG. 25B shows a second modified embodiment.

DETAILED DESCRIPTION

Figure 1:
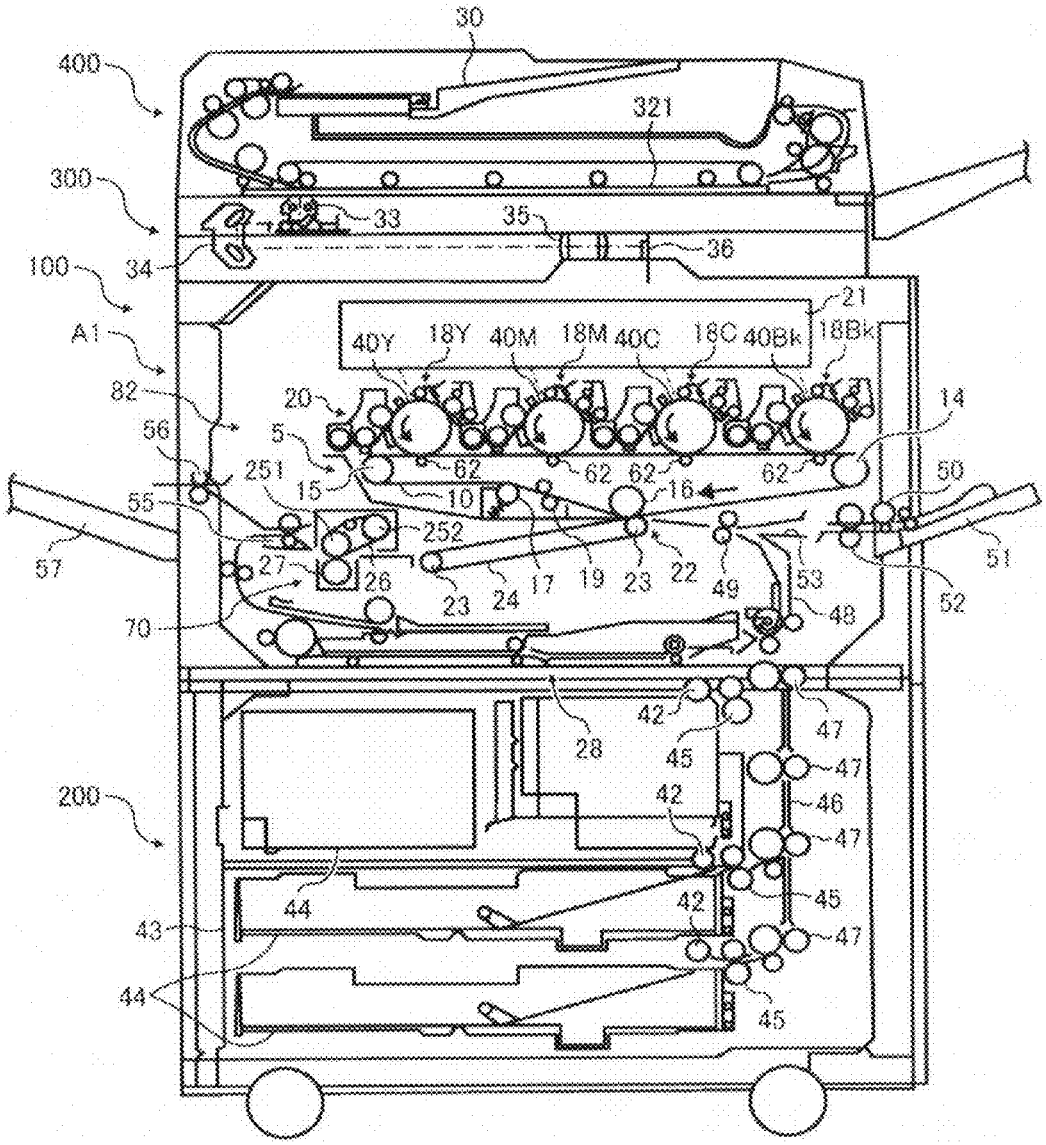
FIG. 1 illustrates a schematic view of an image forming apparatus according to an embodiment of the present invention.

Hereinafter, preferred embodiments of an image forming apparatus will be described.

According to the present invention, when attaching a belt from a proximal side in a roller shaft direction relative to a plurality of rollers supported by side plates, the belt is moved such that an upper surface of the belt moves along a guide member. This movement of the guide member prevents the belt from deviating and interfering with surrounding members, so that the belt is prevented from being damaged.

In each of the following drawings, parts or components having the same function or shape are given the same reference numerals.

FIG. 1 illustrates an image forming apparatus according to a first embodiment of the present invention.

In FIG. 1, the image forming apparatus includes a body 100 of a copier, a sheet feed table 200 disposed below the body 100, a scanner 300 disposed above the body 100, and an automatic document feeder (ADF) 400 disposed above the scanner 300.

The body 100 includes a chassis A1, an endless belt as a transfer belt 10 (hereinafter, to be referred to simply as a transfer belt 10), and a transfer unit 5 as a belt unit to mount the transfer belt 10 in a posture in which the belt is conveyed. The transfer unit 5 as a belt unit will be described in detail later.

As illustrated in FIG. 1, the transfer belt 10 is wound around first to third rollers 14, 15, and 16, respectively, and further, an outer tension roller 17 to apply tension to the belt is disposed at a portion where an outer surface of the belt is directed downward. With such a structure, the transfer belt 10 is wound in a posture at a time of belt conveyance rotatable in clockwise direction.

In the illustrated example, an intermediate transfer member cleaner 19 to remove residual toner remaining on the transfer belt 10 after image transfer is disposed between the third roller 16 and the outer tension roller 17.

In addition, four image forming units 18 for the colors yellow (Y), magenta (M), cyan (C), and black (Bk) are disposed in a horizontal row along the conveyance direction of the transfer belt 10 between the first roller 14 and the second roller 15. These image forming units 18 form a tandem image forming device 20.

As illustrated in FIG. 1, an exposure unit 21 is disposed above the tandem image forming device 20.

Further, between the first and second rollers 14 and 15, and primary transfer rollers 62 to transfer toner images from photoreceptors 40Y to 40Bk to the transfer belt 10 are disposed. Each primary transfer roller 62 is disposed opposite each photoreceptor 40Y to 40Bk with the transfer belt 10 sandwiched in between.

A secondary transfer device 22 is disposed at a position opposite the tandem image forming apparatus 20 with the transfer belt 10 sandwiched in between. In an illustrated example, the secondary transfer device 22 is formed such that a secondary transfer belt 24 being an endless belt is stretched around two rollers 23. The secondary transfer device 22 is formed such that one of the rollers 23 presses the third roller 16 via the transfer belt 10 so that the toner image formed on the transfer belt 10 is transferred to a sheet arriving at the secondary transfer device 22.

A fixing device 70 configured to fix the transferred image onto the sheet is disposed adjacent to the secondary transfer device 22. The fixing device 70 includes a fixing roller 251, a heat roller 252, a fixing belt 26 stretched around the fixing roller 251 and the heat roller 252, and a pressure roller 27. The fixing device 70 is configured such that the pressure roller presses the fixing belt 26.

The secondary transfer device 22 further includes a sheet conveyance function to convey the sheet on which image has been transferred, to the fixing device 70. A non-contact type charger may be used as the secondary transfer device 22; however, in such a case, the sheet conveyance function is lost.

Further, in the illustrated example, a sheet reverse unit 28 to reverse the sheet to print both sides thereof is disposed in parallel to the tandem image forming device 20 and below the secondary transfer device 22 and the fixing device 70.

When a copy is created using the present color copier, a document is set on a document platen 30 of the ADF 400. Alternatively, the document is set on a contact glass 321 on the scanner 300 after opening the ADF 400 and is pressed by the ADF 400 by closing it.

When a start button is pressed with the document placed on the ADF 400, the document moves to the contact glass 321. On the other hand, when the document is placed directly on the contact glass 321, the scanner 300 is driven immediately so that a first carrier 33 and a second carrier 34 are activated. Then, the first carrier 33 emits light from its light source, receives light reflected from a surface of the document, and reflects the received light to the second carrier 34. The second carrier 34 reflects the received light via the mirror toward a focusing lens 35 to be incident to a reading sensor 36 which reads a content of the document.

Pressing the start button on the control panel also causes a driving motor to be driven so that at least one of the rollers 14, 15, and 16, is driven to rotate and other two rollers are driven to rotate accompanied by the rotation of the at least one roller. As a result, the transfer belt 10 is rotated. At the same time, each image forming unit 18 rotates its photoreceptor 40 to form a monochrome image of yellow, magenta, cyan, and black along the conveyance direction on each photoreceptor 40. Then, those monochrome images are sequentially transferred onto the transfer belt 10 while the transfer belt 10 is moving, so that a synthesized color image is formed on the transfer belt 10.

The image forming units 18 each have the same structure except that the color of the developing agent (toner) is different, and therefore, affixes of Y, M, C, and Bk are appropriately omitted in the description hereinafter.

On the other hand, when the start button is pressed, one of sheet feed rollers 42 of the sheet feed table 200 is selectively rotated, so that a sheet is fed out from one of multiple paper trays 44 stored in a paper bank 43. Next, the sheet is separated one by one by a separation roller 45 and inserted into a first conveyance path 46, is conveyed by the conveyance roller 47 to a second conveyance path 48 inside the copier body 100, and stops by contacting a registration roller pair 49.

Otherwise, a sheet feed roller 50 is rotated to feed the sheet on a manual tray 51, the sheet is separated one by one by a manual side separation roller pair 52 and is introduced into a third manual sheet conveyance path 53, and stops by contacting the registration roller pair 49.

Next, the registration roller pair 49 is rotated in synch with a synthesized color image formed on the transfer belt 10 so that the sheet is sent between the transfer belt 10 and the secondary transfer device 22, in which the color image on the transfer belt 10 is transferred by the secondary transfer device 22 and the color image is transferred onto the sheet.

The secondary transfer device 22 includes two support rollers 23 and a secondary transfer belt 24 that can be driven by being stretched around the two support rollers 23.

The secondary transfer device 22 conveys the sheet on which the toner image is transferred, toward the fixing device 70, which applies heat and pressure to the sheet, so that the transferred image is fixed onto the sheet. Then, a pawl 55 switches the direction of the sheet and an ejection roller pair 56 discharges the sheet onto a sheet ejection tray 57 where the sheet is stacked. Alternatively, after being redirected by the pawl 55 to be introduced into the sheet reverse unit 28, in which the sheet is reversed, the sheet is reintroduced to the transfer device and an image is recorded on its backside. Then, the sheet is ejected on the sheet ejection tray 57 via the ejection roller pair 56.

After image transfer, the transfer belt 10 is cleaned by an intermediate transfer member cleaner 19 so that the toner remaining on the transfer belt 10 is removed after the image transfer and readied for a next image formation by the tandem image forming device 20.

The transfer belt 10 is formed of one or multiple layers using polyvinylidene fluoride (PVDF), ethylene tetrafluoroethylene (ETFE) copolymer, polyimide (PI), polycarbonate (PC), and the like. Herein, conductive materials, such as carbon black and the like, are dispersed therein, with a volume resistivity adjusted to be in a range from $10^8$ to $10^{12}$ Ωcm and a surface resistivity in a range from $10^9$ to $10^{13}$ Ωcm. If necessary, a release layer may be additionally coated on top of the transfer belt 10. Examples of material used for coating include ethylene tetrafluoroethylene (ETFE) copolymer, polytetrafluoroethylene (PTFE), polyvinylidene fluoride (PVDF), perfluoroalkoxy (PEA) resins. In addition, fluorine resins of tetrafluoroethylene-hexafluoropropylene copolymer (FEP), polyvinylfluoride (PVF), and the like, may be used.

The transfer belt 10 may be manufactured by molding, centrifugal molding, and the like. The surface of the belt may be polished, if necessary.

If the volume resistivity of the transfer belt 10 exceeds the above range, a higher bias voltage needs to be applied to the belt for image transfer, resulting in a drastic cost increase for the power supply and is thus undesirable. Further, the charged potential of the transfer belt 10 in the transfer process and the transfer sheet releasing process becomes high and the self-discharge of electricity becomes difficult, necessitating some discharging means. Furthermore, if the volume resistivity and the surface resistivity are below the above range, the charged potential quickly attenuates, which is favorable for the discharging by self-discharge of electricity but is unfavorable because the current flows in the surface direction and toner dispersion occurs.

The volume and surface resistivities are measured as follows: Herein, a high resistivity meter (Hiresta IP from Mitsubishi Chemical) is connected with HRS probe (with an inner electrode diameter of 5.9 mm and inner diameter of ring electrode of 11 mm), and voltage of 100 volts to the surface and backside of the transfer belt 10 is applied (with a surface resistivity of 500 volts). Readings taken 10 seconds after voltage has been applied is used.

In addition, preferred materials for the transfer belt 10 include rubber or the like having an elastic layer.

The third roller 16 is disposed opposite the secondary transfer device 22 via the transfer belt 10 and includes a metal core formed of iron or stainless steel (SUS (A−1)) with foamed resins coated thereon. In the present embodiment, the foamed resins have a thickness of from 2 mm to 10 mm, but the thickness is not limited thereto.

Next, polymerized toner used in the present embodiment will be described with reference to FIGS. 2A and 2B.

Figure 2A:
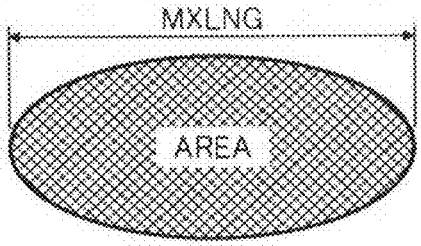
FIG. 2A shows a toner shape factor SF1 and FIG. 2B shows a toner shape factor SF2.
Figure 2B:
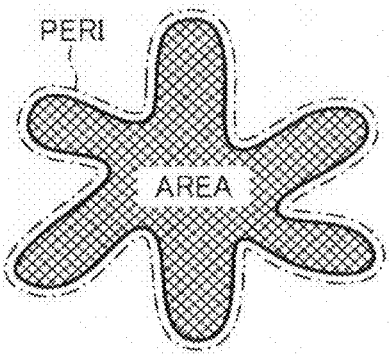

FIGS. 2A and 2B each schematically show a toner shape to explain the shape factor SF1 and the shape factor SF2. The shape factors SF1 of the toner used for the present embodiment preferably range from 100 to 180 and SF2 from 100 to 180. Specifically, the shape factor SF1 shows a degree of circularity of a toner particle, and is represented by the following equation (1):

$$SF1=\{(MXLNG)^2/AREA\}\times(100\pi/4) \quad (1).$$

Here, a value produced by dividing the square of the maximum length MXLNG of an oval figure, which is the projection of the toner particle in a two-dimensional plane, by the area of the figure AREA and then multiplying the resulting quotient by 100π/4.

If the value of SF1 becomes 100, the toner shape is a true sphere. The greater the value of SF1, the more amorphous the toner shape becomes.

The shape factor SF2 is a value representative of the ratio of irregularity in the shape of toner and is represented by the following equation (2):

$$SF2=\{(PERI)^2/AREA\}\times(100/4\pi) \quad (2).$$

Here, a value produced by dividing the square of the peripheral length PERI of a figure, which is the projection of the toner in the two-dimensional plane, by the area AREA of the figure and then multiplying the resulting quotient by 100/4π.

If the value of SF2 becomes 100, no irregularity on the toner surface exists. The greater the value of SF2 is, the more remarkable the irregularity on the toner surface becomes.

The shape factors may be measured using a photograph of toner taken using a scanning electroscope (S-800, trade name, manufactured by Hitachi, Ltd.) and the image analyzed with an image analyzer (LUSEX3, trade name, manufactured by NIRECO Corp.).

As the toner shape approaches a sphere, toner-to-toner or toner-to-photoreceptor contact is made only by point-to-point contact, and the toner-to-toner attracting power decreases, thereby increasing fluidity. The attracting power between the toner and the photoreceptor also decreases, thereby increasing transferability. If either of the SF1 and SF2 exceeds 180, transferability decreases and the cleanability of the toner attached to the transfer device also decreases, which is undesirable.

The favorable toner particle diameter is ranging from 4 to 10 μm. If the toner particle diameter is less than 4 μm, background contamination is caused during the development, fluidity is degraded and agglomeration tends to occur, and then the white omission tends to occur. By contrast, if the toner particle diameter is greater than 10 μm, toner dispersion occurs and a high quality image cannot be obtained due to the degraded resolution.

In the present embodiment, toner with the volume average particle diameter of 6.5 μm is used.

A structure of the copier body 100 will be described in detail referring to FIG. 1.

The copier body 100 includes a transfer unit 5 as a belt unit, a chassis A1 incorporating the transfer unit 5, and a front opening 82, disposed at a proximal side of the body 100, through which the transfer unit 5 can be pulled out in the proximal direction.

Figure 3:
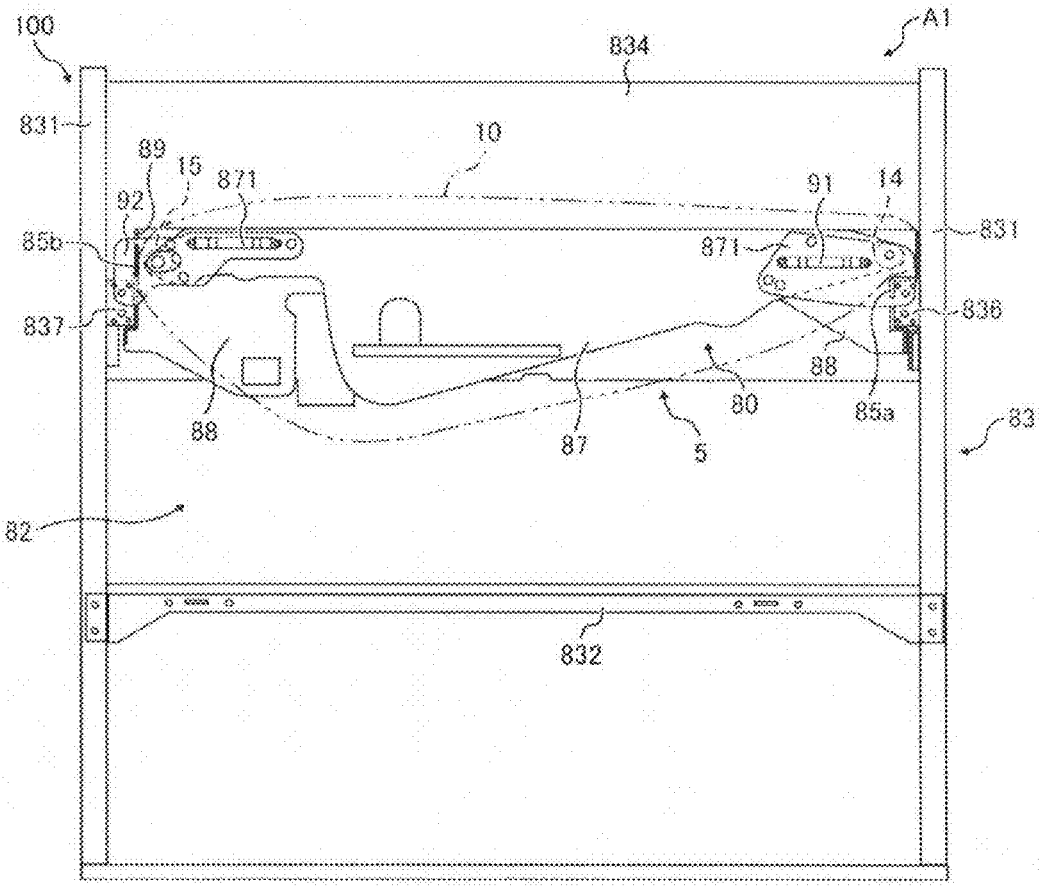
FIG. 3 illustrates a front view of an outer frame of a chassis of the image forming apparatus of FIG. 1.
Figure 8:
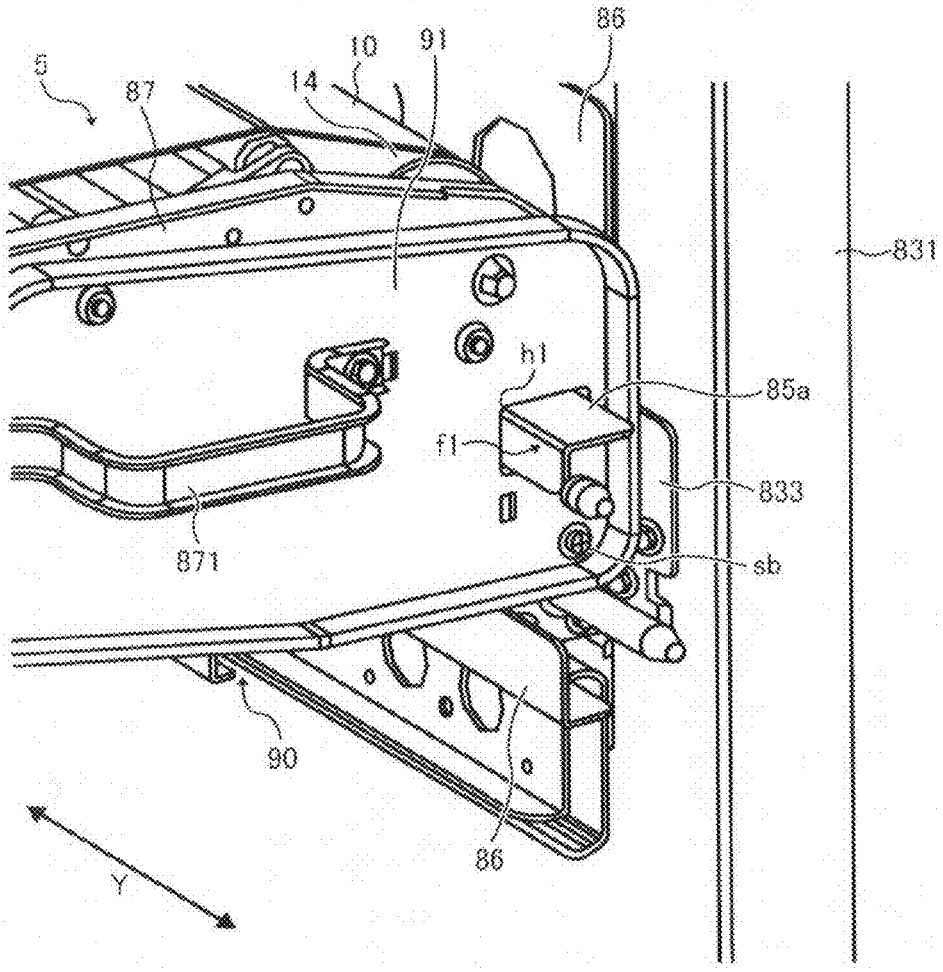
FIG. 8 illustrates a perspective partial view illustrating a mounting structure of the right side of the transfer unit inside the chassis of FIG. 3.

Herein, as illustrated in FIGS. 3, 8, and 13, the transfer unit 5 is configured such that the endless transfer belt 10 is wound around the first and second rollers 14 and 15, which are separated from each other maximally. Herein, the first and second rollers 14, 15 are disposed in a distal side than the proximal side and a front side plate 87 extending in a lateral side (see FIGS. 3 and 5) supports the proximal side, thereby forming a belt unit frame 80.

Figure 5:
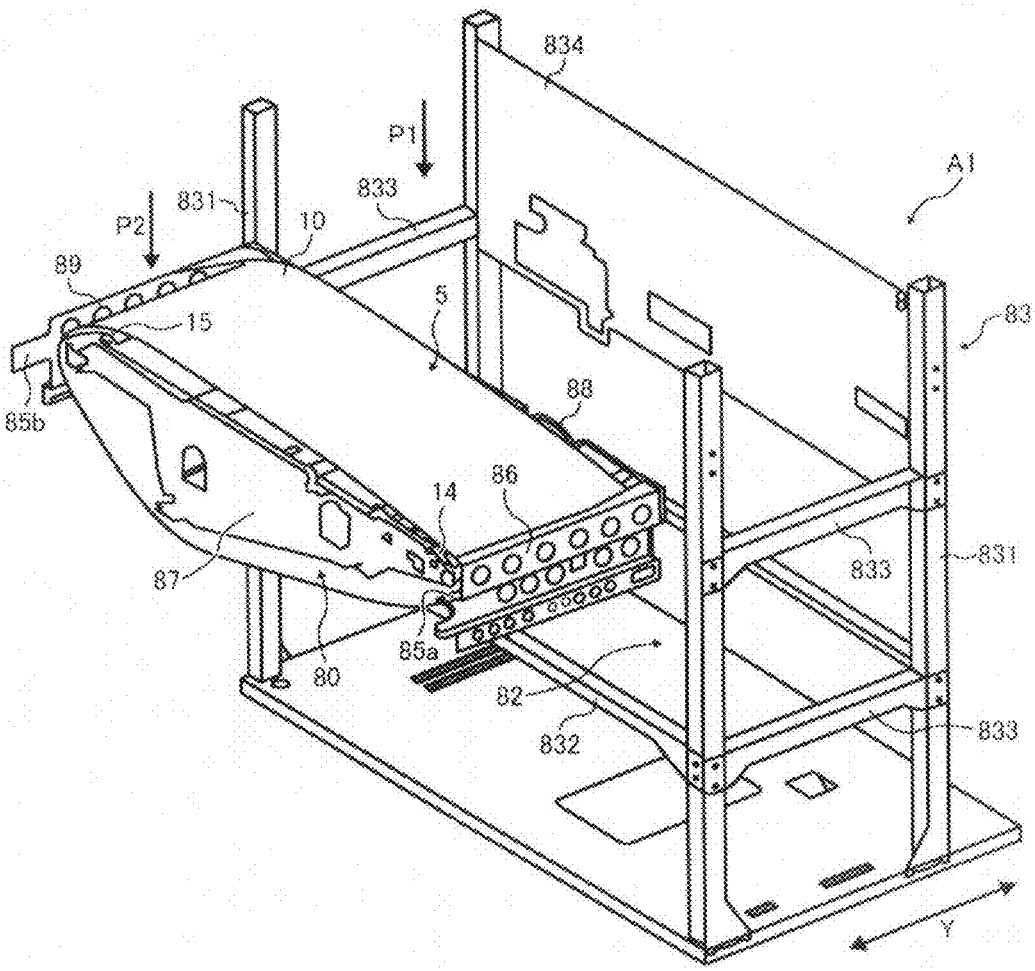
FIG. 5 illustrates an exploded perspective front view of the outer frame.
Figure 6:
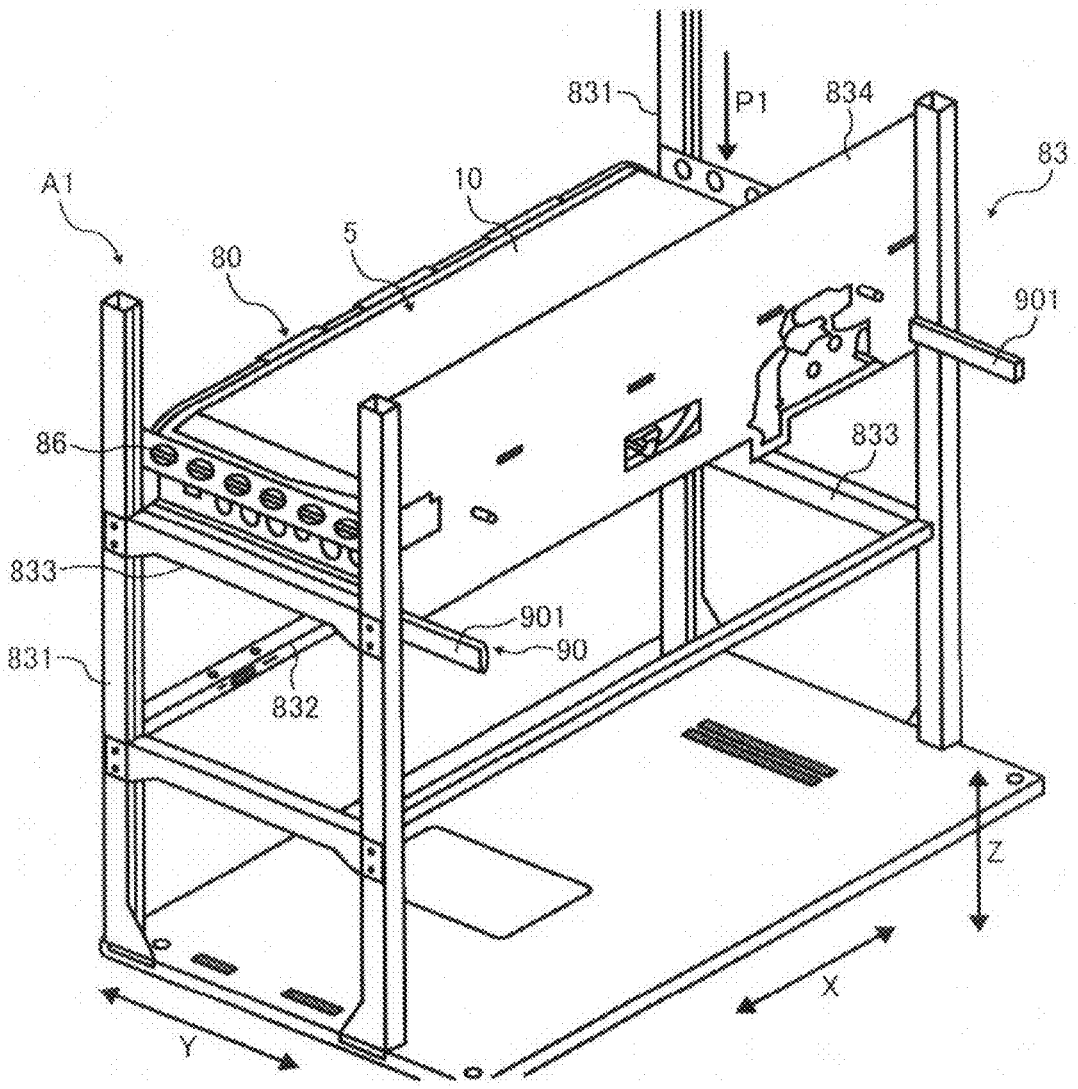
FIG. 6 illustrates a perspective rear side view of the outer frame of the chassis of FIG. 3.

Further, the chassis A1 of the copier body 100 supports such that the belt unit frame 80 can be pulled out to the proximal side as illustrated in FIG. 5. In particular, the chassis A1 includes guide members 85*a*, 85*b* (collectively, guide member 85) (FIG. 3 shows a right guide member 85*a* alone of the front side plate 87) disposed at lateral sides and projected so that the transfer belt 10 is guided toward the proximal side.

Figure 19:
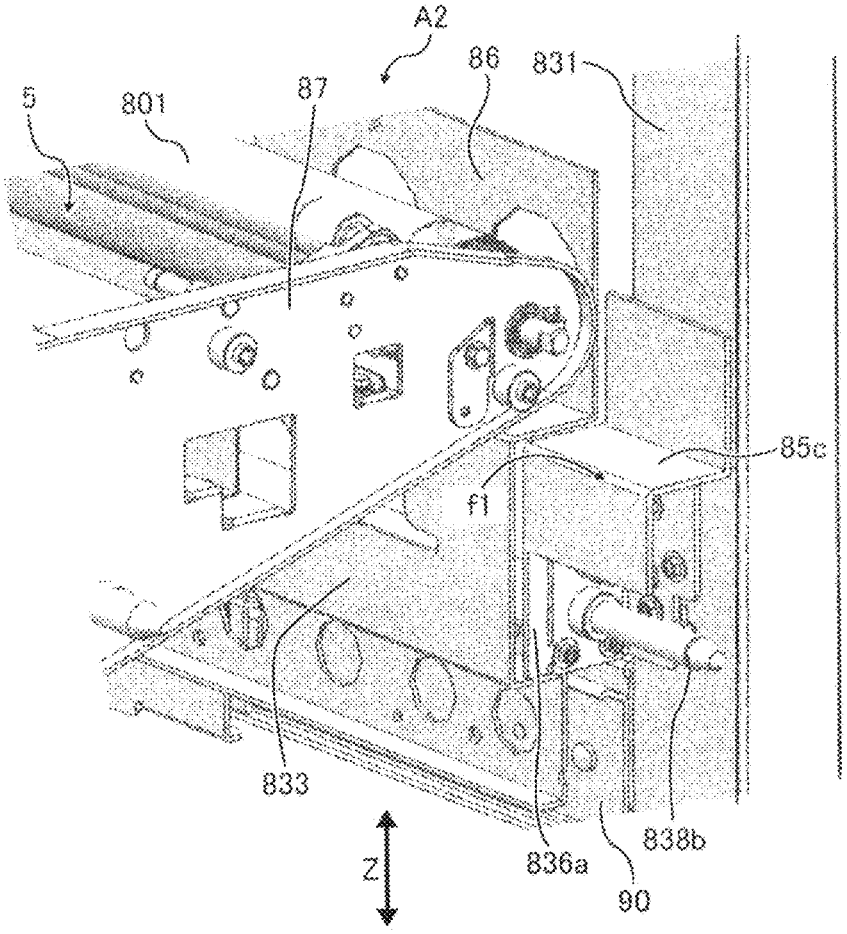
FIG. 19 illustrates a perspective view illustrating a guide surface used in the right side mounting structure of the guide member according to the second embodiment of the present invention.
Figure 20:
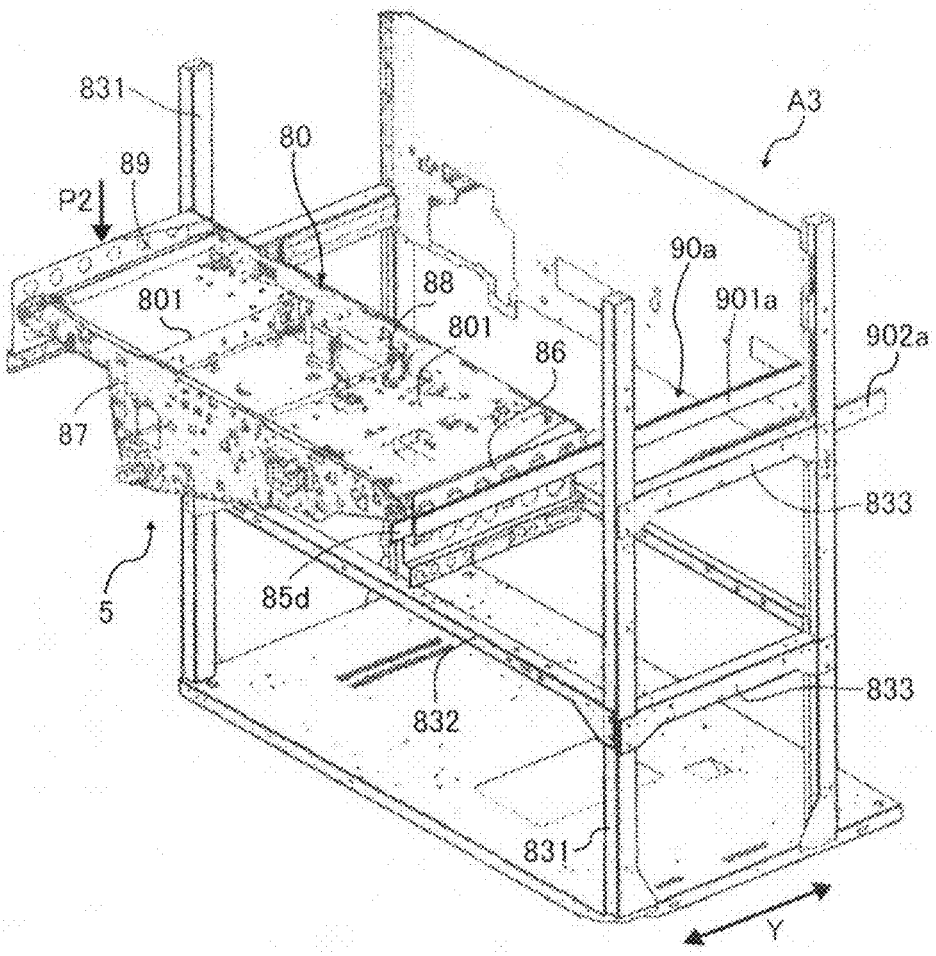
FIG. 20 illustrates a perspective view illustrating the guide member used in the image forming apparatus when a belt support frame is drawn according to another embodiment of the present invention.

The belt unit frame 80 includes the front side plate 87 and a rear side plate 88. The front side plate 87 is a first side plate to support the proximal side in an axial direction of the first and second rollers 14, 15 and the rear side plate 88 is a second side plate supporting the other rear end in the axial direction of the first and second rollers 14, 15. Further, as illustrated in FIGS. 19 and 20, a stay 801 integrates the front side plate 87 and the rear side plate 88, and connecting side plates 86, 89 that extend with a curve toward the front from the rear side plate 88.

The belt unit frame 80 is supported by the chassis A1 such that the connecting side plates 86, 89 disposed at the lateral ends of the belt unit frame 80 are supported by the chassis A1 via the slide rail 90.

Figure 24:
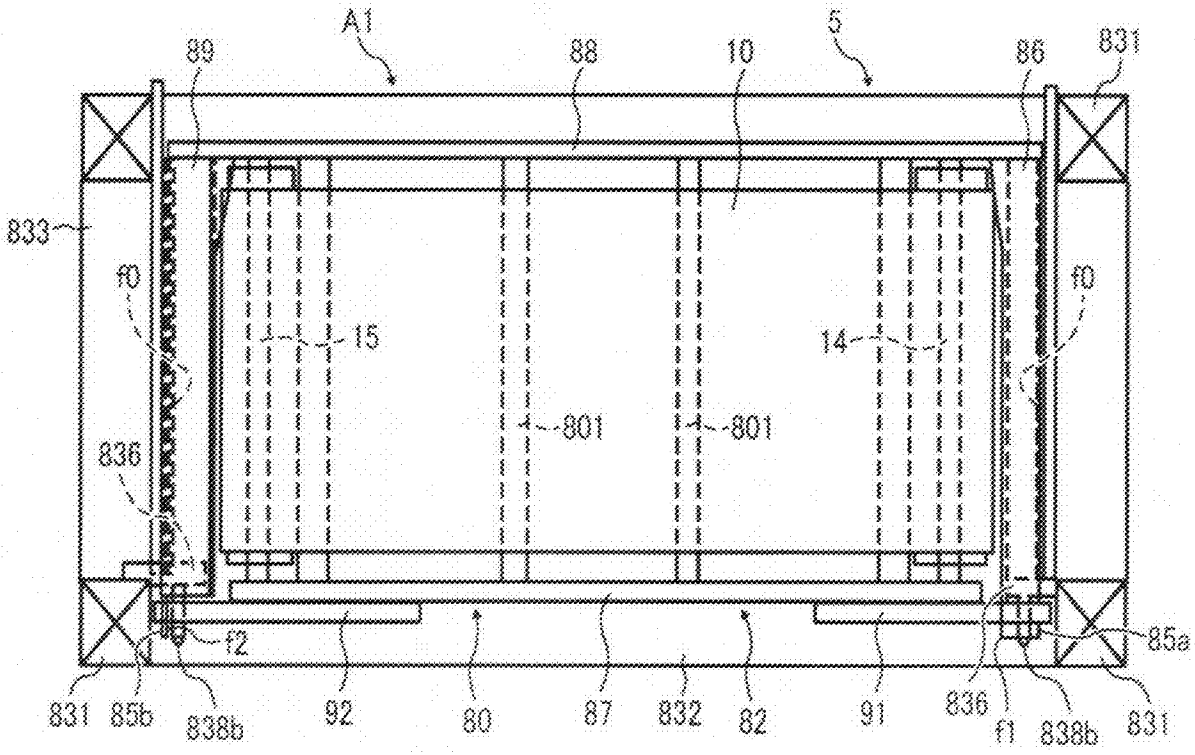
FIG. 24 illustrates a perspective plan view illustrating relative positions of the positioning plate and the guide member used in the image forming apparatus according to the embodiment of the present invention.

Herein, the right and left connecting side plates 86, 89 cover an outer area of the first and second rollers 14, 15 disposed at lateral ends of the belt unit frame 80 with a predetermined interval from the belt unit frame 80 as illustrated in FIG. 24.

Guide members 85*a* and 85*b* to guide the transfer belt 10 are disposed at proximal sides of the right and left connecting side plates 86, 89. The guide member 85 includes a projection projecting from a surface of the belt in the longitudinal direction.

A pair of right and left connecting side plates 86, 89 disposed at distal sides of the guide member 85 each includes a vertical wall and forms an inner side guide surface f0 that continues from guide surfaces f1, f2. As illustrated in FIG. 13, a projection at an end of a guide member 85*d* fits a slit of a left joint plate 92 and regulates a position of the guide member 85*d*.

Thus, each guide member 85*a*, 85*b* positions proximally at an outside of the belt unit frame 80 or the transfer unit 5; however, each guide member 85*a*, 85*b* may be supported at an edge of the opening of the front opening 82 of the outer frame 83 of the copier body 100 according to a second embodiment, which will be described later.

In brief, the transfer belt 10 is taken out as a whole unit and is kept in a unit detachment posture as shown by a broken line in FIG. 3, is pulled in a proximal direction along the roller axis direction relative to the transfer unit 5, and is mounted from the proximal side. In this operation, what is needed is to prevent the outer circumferential surface of the transfer belt 10 in the unit detachment posture from interfering with the surrounding members around the edge of the opening by the guide surfaces f1, f2 of the respective guide members 85*a*, 85*b*, which will be described later, so that the outer circumferential surface of the transfer belt 10 is prevented from being damaged.

Further, a pair of guide members 85*a*, 85*b* positions at a proximal end of the right and left connecting side plates 86, 89 and is disposed opposite the pair of first and second rollers 14, 15, respectively.

For example, the guide surfaces f0, f1 of the right connecting side plate 86 and the guide member 85*d* disposed proximally of the connecting side plate move together, so that the outer circumferential surface of the transfer belt 10 does not interfere with the other peripheral parts at the edge of the opening, which is preferred.

Alternatively, as in another embodiment which will be described later (see 85*c* in FIG. 19), a support pillar 831 forming an opening edge of the front opening 82 supports the guide member 85 and functions to prevent the outer circumferential surface of the transfer belt 10 from interfering with the surrounding members.

Next, referring to FIGS. 3 to 6, the chassis A1 included in the image forming apparatus will be described.

The image forming apparatus includes the transfer unit 5, the outer frame 83, the front opening 82 formed on the outer frame 83, and a cover to open and close the front opening 82.

The front opening 82 retains a shape capable of allowing withdrawal of the transfer unit 5 in a proximal direction in FIG. 3 in the axial direction of the first and second rollers 14, 15 and winding it around the rollers 14, 15 again. The front opening 82 is closed by a cover. The chassis A1 includes herein the outer frame 83, the front opening 82, and an opening for a cover.

Herein, a belt unit mounting portion (as a regular position, which will be described later) is secured in a space inside the outer frame 83 forming a main part of the chassis A1. The transfer unit 5 as a belt unit is mounted in the regular position P1 in a state of belt conveying posture (as illustrated by a solid line in FIG. 1).

Figure 4:
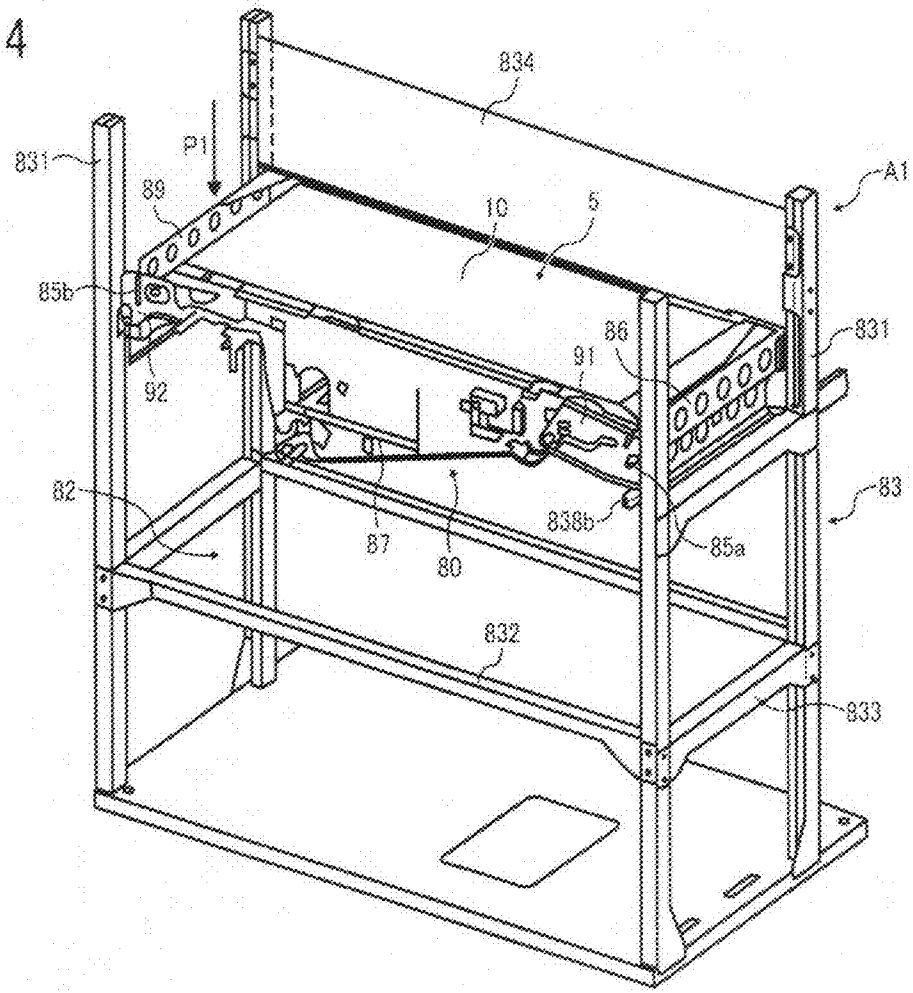
FIG. 4 illustrates a perspective front view of the outer frame of the chassis of FIG. 3.

As illustrated in FIGS. 4 and 24, the outer frame 83 is formed as a three-dimensional rectangular frame by integrally coupling a plurality of support pillars 831, front and rear stays 832, lateral stays 833, and a rear face plate 834.

The transfer unit 5 is installed in the inner upper space of the thus-constructed outer frame 83. The belt unit frame 80 of the transfer unit 5 is supported by the lateral stays 833 via the slide rail 90.

Figure 7:
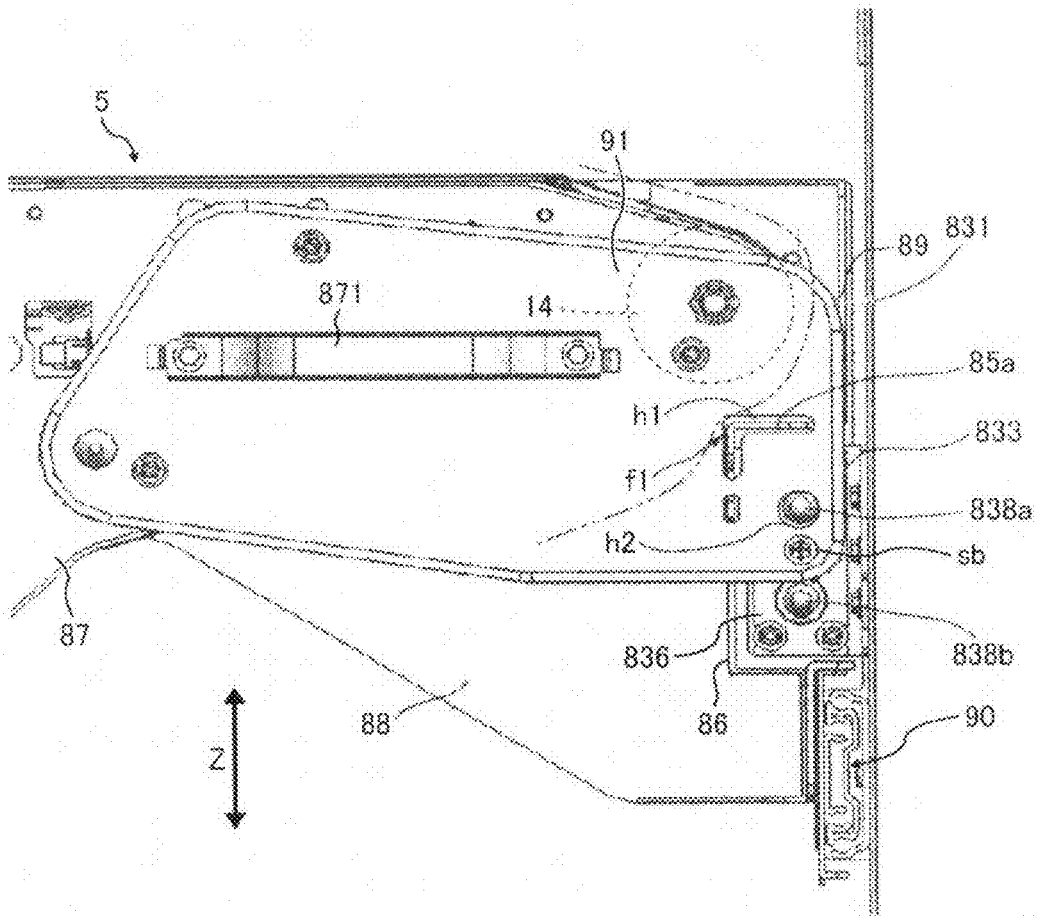
FIG. 7 illustrates an enlarged partial front view illustrating a mounting structure of a right side of a transfer unit inside the chassis of FIG. 3.
Figure 12:
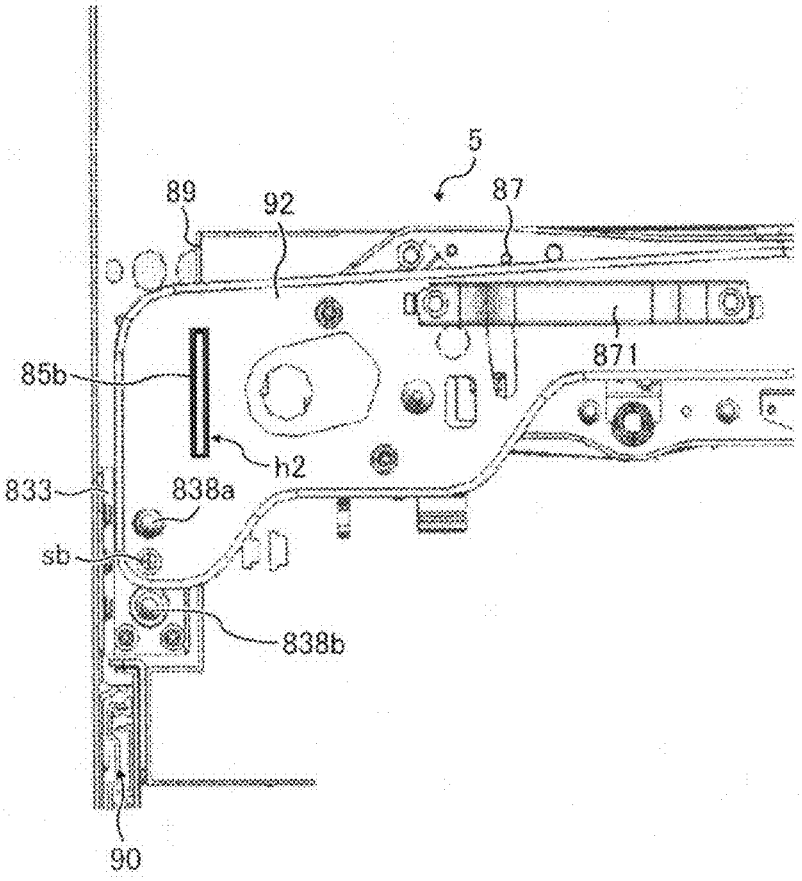
FIG. 12 illustrates an enlarged partial front view illustrating a left side mounting structure of the transfer unit in the chassis of FIG. 3.

As illustrated in FIGS. 1, and 3 to 6, the belt unit frame 80 includes the right and left connecting side plates 86 which are supported by and joined with the lateral stays 833 (see, for example, FIG. 5) via the slide rail 90 (see FIGS. 7 and 12).

With the structure above, bottom sides (see FIG. 7) of the right connecting side plate 86 of the transfer unit 5 connect to a movable rail 901 of the slide rail 90 relative to the lateral stays 833 so as to be movably supported in a proximal-distal direction Y of the chassis A1. With this structure, the transfer unit 5 can be easily pulled out to the proximal side in the proximal-distal direction Y during maintenance and wound again after the maintenance is complete, through the front opening 82 sectioned by the front and rear, and right and left support pillars 831 of the outer frame 83 and upper and lower, front and rear stays 832 (of which an upper and front stay is not shown).

FIG. 4 shows a retracted state of the transfer unit 5. At the time of maintenance, the transfer unit 5 once moves to a position suitable for removal and mounting which is lower than the regular position P1. Then, as illustrated in FIG. 5, the transfer unit 5 is held at a pull-out position P2 in the proximal side in the proximal-distal direction Y than the front opening 82.

In the retracted state in which the transfer unit 5 is held in the regular position P1, as illustrated in FIGS. 7 and 8, the transfer unit 5 is positioned such that a right end portion of the front side plate 87 is fastened to the front side right support pillar 831 via a right joint plate 91 as a positioning member. Herein, a positioning plate 836 (837 denotes a positioning plate on the left, see FIG. 3) and a front edge of a right stay 833 as parts around the edge portion of the opening of the front opening 82 are integrally formed with the front, right support pillar 831. The right end portion of the front side plate 87 of the transfer unit 5 is fastened at several portions to the positioning plate 836 integrally formed with the right support pillar 831 via the right joint plate 91 as a positioning member.

Herein, the transfer unit 5 (or the belt unit) employs the guide member 85*a* as a first positioning pin. The chassis A1 includes a positioning pin 838*a* as a second positioning pin and a guide pin 838*b* as an engagement pin disposed in the vicinity of the positioning pin 838*a*, both pins protrude toward a proximal side from the positioning plate 836 (see FIGS. 7 and 18A).

As shown in FIG. 7, the right joint plate 91 as a positioning member includes a first positioning slit h1 into which the guide member 85*a* as a first positioning pin is inserted and a second positioning slit h2 into which the positioning pin 838*a* as a second positioning pin is inserted. At the same time, a bottom end j1 of the right joint plate 91 is stopped by an upper surface of the guide pin 838*b* as an engagement pin (see FIGS. 18A and 18B). With this configuration, the right joint plate 91 integrally coupled with the transfer unit 5 is securely positioned from all sides relative to the positioning plate 836 of the side of the chassis A1. With such an uncomplicated structure using pins and slits, positioning can be secured.

Further, as illustrated in FIG. 7, the guide pin 838*b* serves as a positioning member for the transfer unit 5 and the right joint plate 91 and supports the right joint plate 91 by contacting a bottom end of the right joint plate 91 when mounting the right joint plate 91 moving it from the proximate side to the distal side in the figure. Thus, the guide pin 838*b* performs a positional control to support the positioning pin 838*a* and the guide member 85*a* to enter into the positioning slits h1, h2.

Namely, the transfer unit 5 is installed in the chassis A1 and is held at the regular position P1. In this state, the right joint plate 91 includes the positioning slits h1, h2. The guide member 85*a* and the positioning pin 838*a* protruding from the positioning plate 836 are inserted into the slits h1, h2, so that the transfer unit 5 as the belt unit can be positioned in the chassis A1 easily. In addition, because the guide member 85*a* that protrudes from the front side plate 87 is configured to insert into the slit h1, the positioning member does not protrude largely from the front side plate toward front. Thus, the apparatus is prevented from becoming large.

In addition, because the bottom portion of the right joint plate 91 contacts the guide pin 838*h*, positioning of a vertical direction Z is performed. As a result, when an inner distal side of the transfer unit and the positioning member supported via the outer frame 83 sinks due to its own weight, the guide pin 838*b* serves to support them. Here, 'sb' denotes a stopper bis (see FIG. 7).

Figure 9:
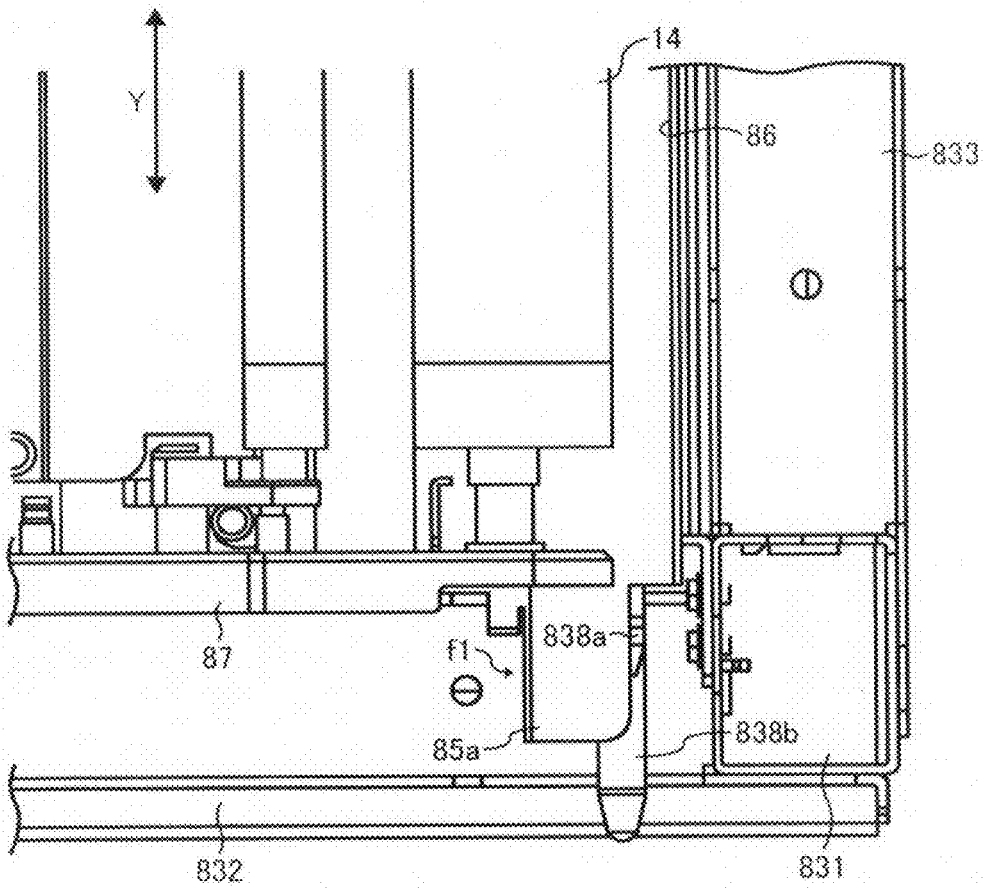
FIG. 9 illustrates a partial plan view excluding a transfer belt from the right side mounting structure of the transfer unit in the chassis of FIG. 3.

As such, when pulling out toward front the transfer unit 5 and the right joint plate 91 and mounting them thereafter, the positioning pin 838*a* and the guide member 85*a* of the right connecting side plate 86 engage with positioning slits h1, h2 of the right joint plate 91 (see FIGS. 8 and 9). With this structure, the transfer unit 5 can be securely positioned relative to the outer frame 83 of the chassis A1, so that the belt detachment can be done at ease.

Figure 18A:
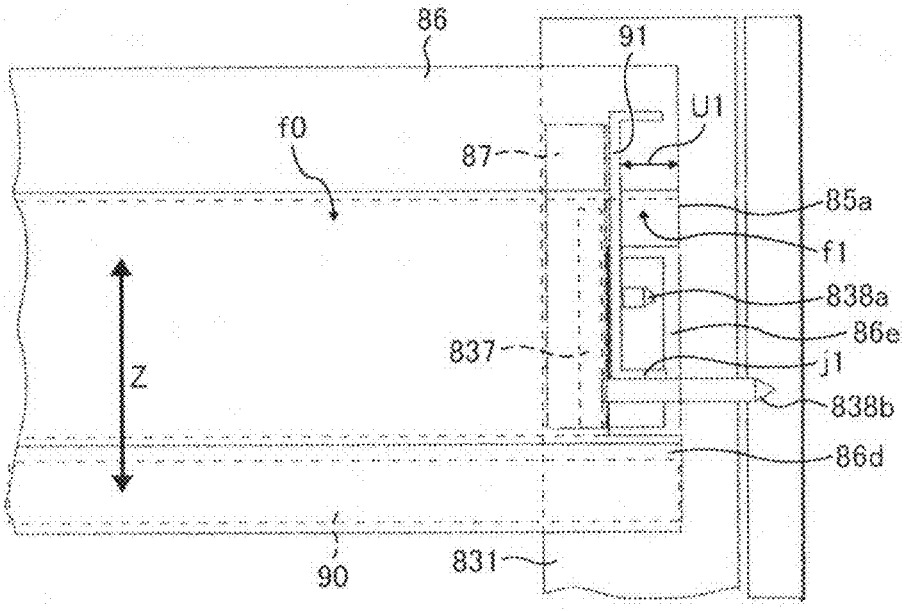
FIGS. 18A and 18B illustrate a positioning plate and guide member as a right side mounting structure of FIG. 3.

Further, as illustrated in FIG. 18A, the proximal upper side of the connecting side plate 86 (right side in the figure) is formed as the guide member 85*a*, and a bottom end 86*d* has a same height of projection as that of the guide member 85*a*. A recessed portion 86*e* positions between the guide member 85*a* and the bottom end 86*d*. The recessed portion 86*e* is retracted from front relative to the guide member 85 and the bottom end 86*d* by a distance U1, using which the right joint plate 91 is retracted backward from the guide member 85 for replacement. Further, the distance U1 enables the guide member 85*a* and the positioning pin 838*a* to be inserted into the positioning slits h1, h2 of the right joint plate 91.

Further, the guide pin 838*b* is used for positioning the openably closable cover. A handle 871 may be used to pull out the right joint plate of the transfer unit 5 from the regular position P1 inside the chassis A1 to the pull-out position P2.

Next, how to mount a left end portion of the front side plate 87 of the transfer unit 5 to a left end portion of the chassis A1 will be described.

Figure 13A:
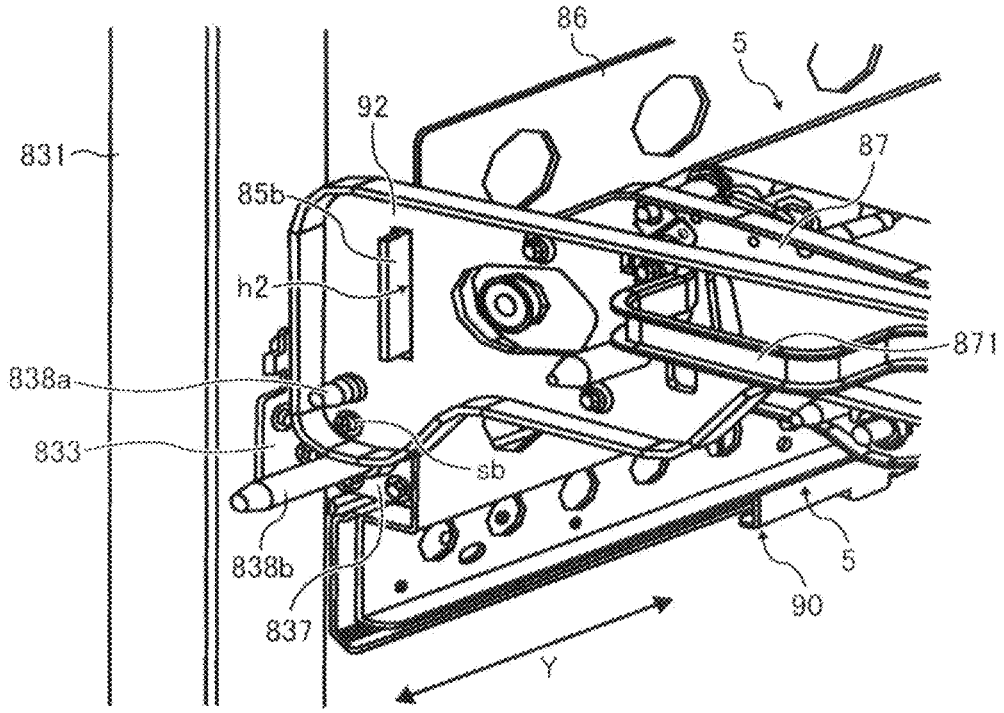
FIG. 13A illustrates a perspective partial view of the left side mounting structure of the transfer unit in the chassis of FIG. 3
Figure 13B:
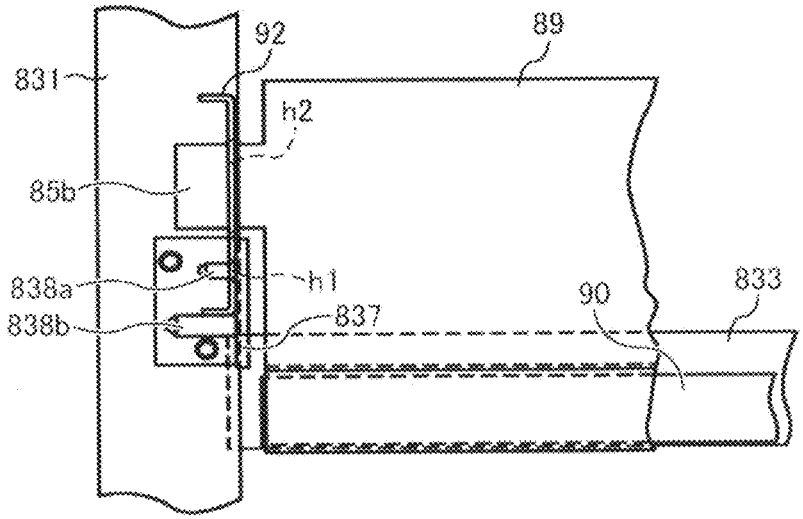
FIG. 13B is an explanatory view of an inserting status of a guide member.

As illustrated in FIGS. 12 and 13, the left end portion of the front side plate 87 of the transfer unit 5 is fastened at several portions to the positioning plate 836 integrally formed with the front left support pillar 831 via the left joint plate 92. As illustrated in FIGS. 13A and 13B, the positioning plate 836 includes the positioning pin 838*a* and the guide pin 838*b* both protruding forward. A vertical planar guide member 85*b* extending forward is formed at a front end of the left connecting side plate 89 of the transfer unit 5. The guide member 85*b* is formed to be inserted into the positioning slit h2 of the left joint plate 92.

Note that the left connecting side plate 89 is curved to prevent interfering with the positioning plate 836 and the vertical planar guide member 85*b* that extends forward is inserted into the positioning slit h2 of the left joint plate 92.

As illustrated in FIG. 13A, when the front side plate 87 of the transfer unit 5 engages by being inserted into the positioning slit h2 of the left joint plate 92, positional error of the side of the front side plate 87 of the transfer unit 5 can be prevented. Further, when the left joint plate 92 is removed from the front side plate 87 during maintenance, the guide member 85*b* makes a detachment/attachment of the belt and rewinding of the belt easier.

Figure 14A:
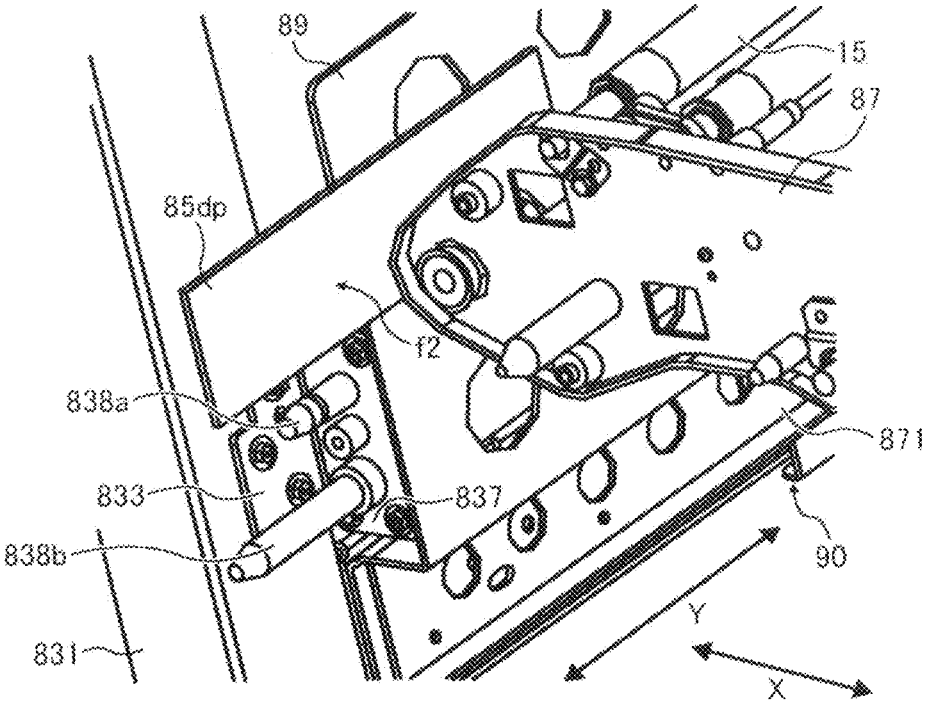
FIGS. 14A and 14B each illustrate a modified example of the left side mounting structure of the transfer unit in the chassis of FIG. 3.
Figure 14B:
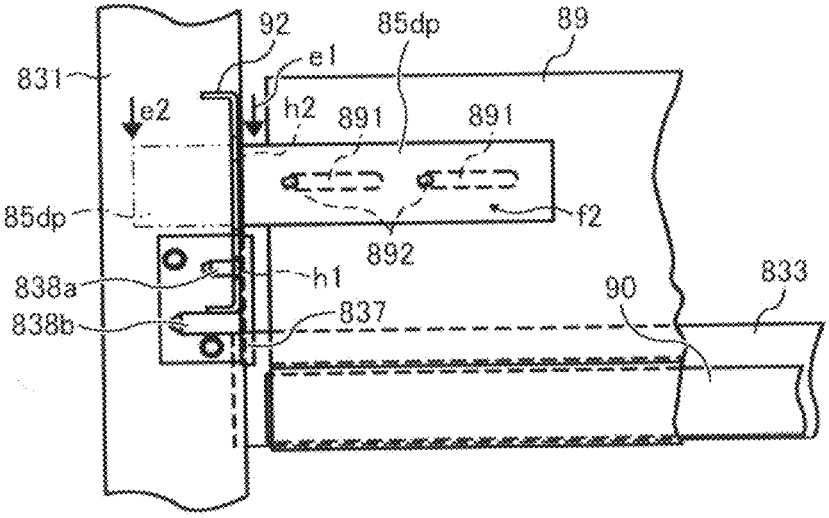
Figure 15:
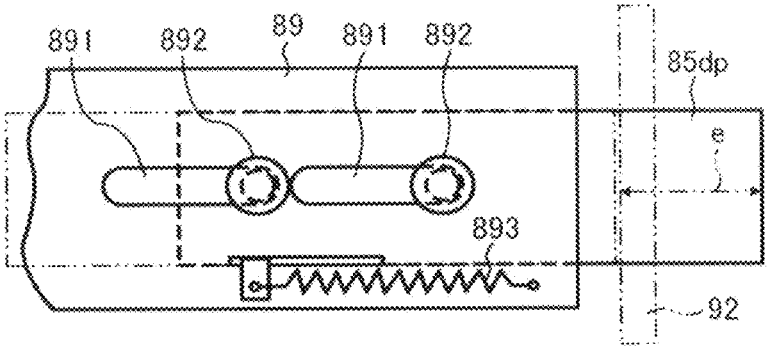
FIG. 15 illustrates a sliding mechanism of the guide member supported by an unit joint frame as a modified example of FIG. 14B.

Herein, the vertical planar guide member 85*b* is integrally formed at a front portion of the left connecting side plate 89. Alternatively, a movable guide plate 85*dp* can be slidably supported to the front portion of the left connecting side plate 89 via a pair of engagement pins 892. In this case, as illustrated in FIGS. 14A and 14B, the movable guide plate 85*dp* is held at a front end of the left connecting side plate 89 via the engagement pins 892. In particular, the movable guide plate 85*dp* is retractably disposed. As illustrated in FIG. 15, a pair of long slits 891 is disposed with an interval each other and on a line at a front end of the left connecting side plate 89. The engagement pins 892 of the movable guide plate 85*dp* are slidably and fixedly engaged with the pair of long slits 891 within a slidable range of E. Further, the movable guide plate

85*dp* is pressed by a spring to protrude at a guided position (as illustrated by a solid line in FIGS. 14B and 15), and is movably held at a holding position (as shown by a broken line in FIG. 15) in response to elastic displacement of the spring.

When the movable guide plate 85*dp* is held at the guided position, a protruding-forward amount of the vertical guide surface f2 becomes relatively large, and the outer circumferential surface of the transfer belt 10 is proximally pulled and is slid in the mounting direction. Further, when the left joint plate 92 is fastened to the front side plate 87, the left joint plate 92 displaces by a retraction length E to a retracted position (as illustrated by a broken line in FIG. 15), thereby preventing mutual interference.

Thus, except in the attachment/detachment of the transfer belt 10, the movable guide plate 85*dp* can be held at a retracted position, thereby saving a space.

Figure 25A:
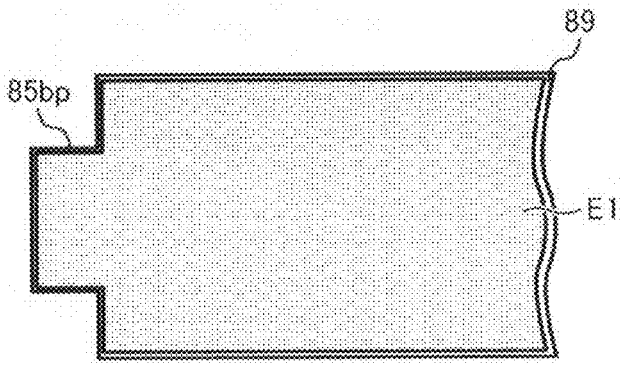
Figure 25B:
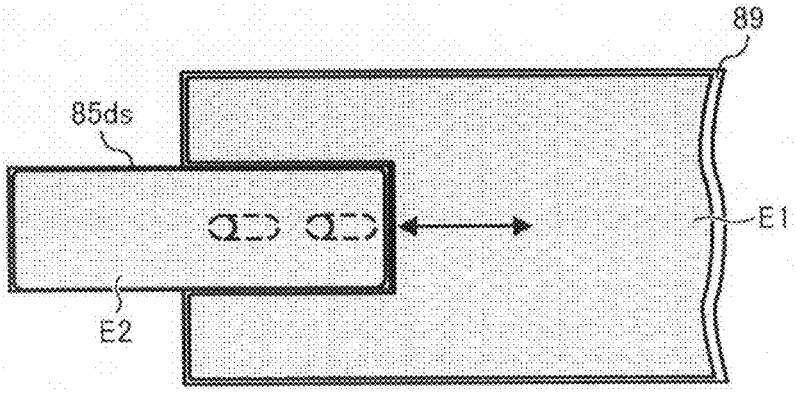

The vertical guide surface f2 (belt contact surface) of the planar guide member 85*b* and the movable guide plate 85*dp* is a planar metal surface. Instead, a main part E1 of a planar guide member 85*bp* or the left connecting side plate 89 as illustrated in FIG. 25A, and the main part E1 of the left connecting side plate 89 and a main part E2 of a movable guide member 85*ds* as illustrated in FIG. 25B may be implanted with short fiber.

In such a case, because the material of resinous fiber is implanted, slidability is improved, thereby securing the durability. In particular, the guide member can be guided to move smoothly back and forth without its surface being damaged. Further, abrasion-resistant seal and mylar (a registered trademark of E. I. du Pont de Nemours and Company ("Dupont")) can be attached to a planar guide member 85*p* and the transfer belt 10.

As illustrated in FIGS. 12, 13A, and 13B, a bottom end of the left joint plate 92 contacts the guide pin 838*b*, so that the positioning in the vertical direction Z is performed, and this guide pin 838*b* is used for positioning an openably closable cover. Further, each handle 871 (see FIG. 7) can be used to pull out the transfer unit 5 from the regular position P1 in the chassis A1 to the pull-out position P2 as illustrated in FIG. 5.

In the description above, the planar guide member 85*p* is supported by a front end of the left connecting side plate 89; however, as another embodiment, the planar guide member 85*p* can be attached to the frontal side, left support pillar 831 (on the side of the outer frame 83). Details of another embodiment will be described later. Further, the planar guide member 85*p* is not curved, but may be formed to have a curve if required from the layout. The planar guide member 85*p* is a sheet metal but may be formed of resins or die-cast alloy.

Next, how to pull out the transfer unit 5 as the belt unit support unit will be described.

A front cover is opened during maintenance and the front opening 82 is exposed to outside.

The transfer unit 5 is held in a posture of unit attachment/detachment at the regular position P1 at the time of maintenance. In that posture, the transfer unit 5 is switched to a posture of unit detachment. The right and left handles 871 are used to pull out the transfer unit 5 from the regular position P1 in the outer frame 83 as illustrated in FIG. 4 to the pull-out position P2 (see FIG. 5).

The transfer unit 5 is held in a posture of unit attachment/detachment at the time of maintenance.

After that, the outer tension roller 17 is removed from the transfer belt 10 on the transfer unit 5, so that the transfer belt 10 is loosened.

Then, three rollers 14, 15, and 16 are shifted to a waiting position downstream in the shift direction from the regular position P1. In this case, the transfer belt 10 is loosely stretched as illustrated by the broken line in FIG. 3, and the posture of unit attachment/detachment is held.

Herein, in removing the transfer unit 5, the transfer belt 10 is loosely stretched around the rollers 14 and 15 farthest apart and a loose tension is applied to the belt 10. In this case, the tension regulates a position of the belt 10, thereby preventing contact with members other than the belt 10, and the unit 5 can be taken out relatively easily.

Thereafter, the loosened transfer belt 10 is wound at an end portion of the pair of rollers 14 and 15.

In winding operation toward the winding direction, the loosened transfer belt 10 expands laterally so that it is troublesome to wind the belt at the ends of the rollers 14 and 15 while preventing the transfer belt 10 from expanding. Then, in the present embodiment, guide members 85*a*, 85*b*, 85*dp*, 85*c*, and 85*p* already described or to be described later are used to make the mounting operation of the belt 10 easier.

Figure 16:
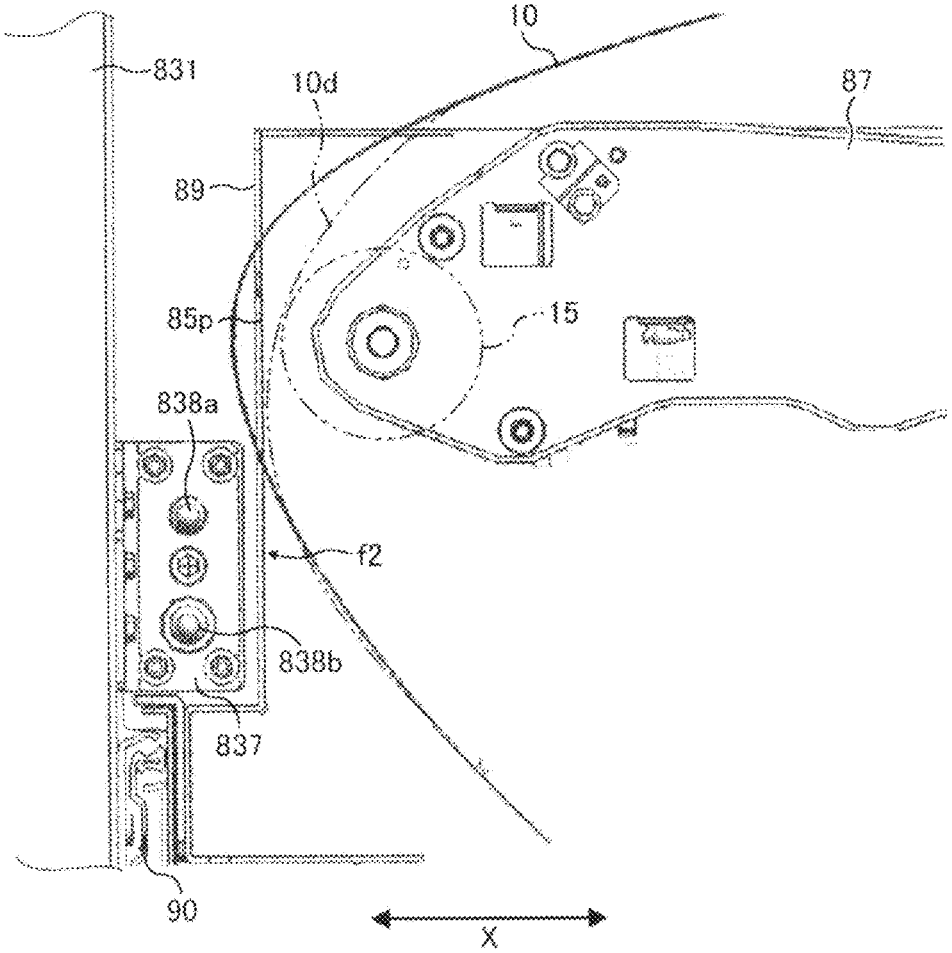
FIG. 16 illustrates a position controlling function of a planar guide member supported by the unit joint frame of the transfer unit of FIG. 13.
Figure 17:
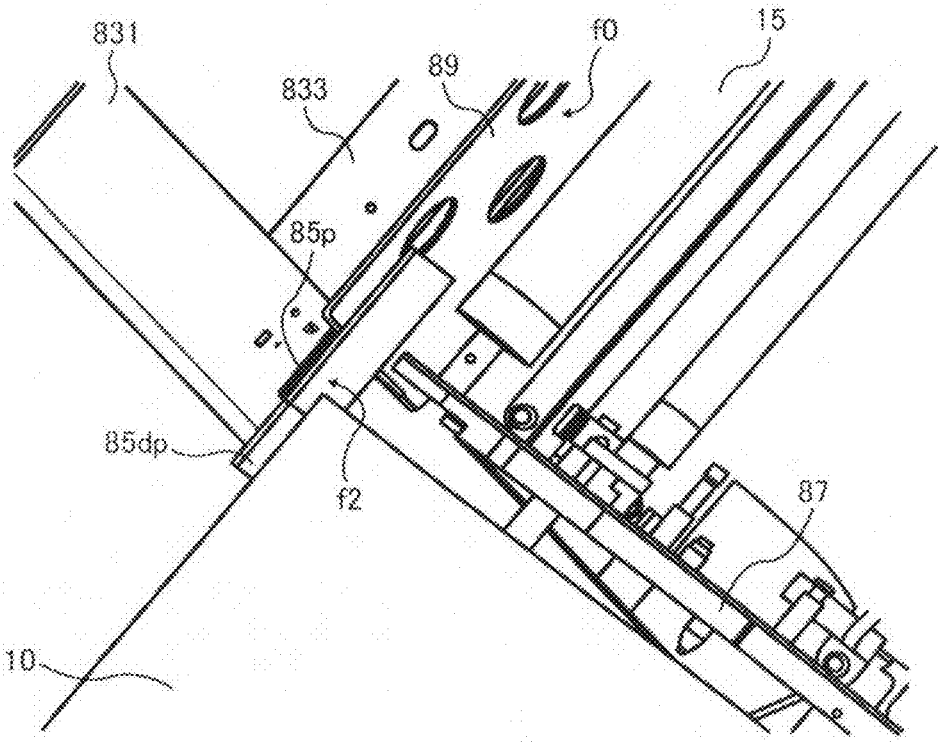
FIG. 17 illustrates a perspective partial view when the transfer unit is drawn along the movable guide member supported by the unit joint frame of the transfer unit of FIG. 14.

Specifically, the guide surface f0 of the right and left connecting side plates 86, 89, the guide surface f1 and the vertical guide surface 12 of the frontal right side guide member 85*a* at the proximal side and the left side planar guide members 85*b*, 89*dp* prevent the transfer belt 10 from bending excessively toward the lateral direction. The vertical guide surface 12 are illustrated in FIGS. 14B and 17, and the transfer belt 10 is illustrated in FIG. 16 by a solid line. The vertical guide surface f2 displaces the transfer belt 10 toward the roller 15 (refer to a broken line 10*d* in FIG. 16) to prevent a belt surface from displacing excessively. Thus, the movement of the belt 10 in the mounting direction is made easier.

Accordingly, when the transfer belt 10, if deteriorated, is replaced with a new one, the new transfer belt 10 can be mounted easily on the transfer unit 5.

Figure 10:
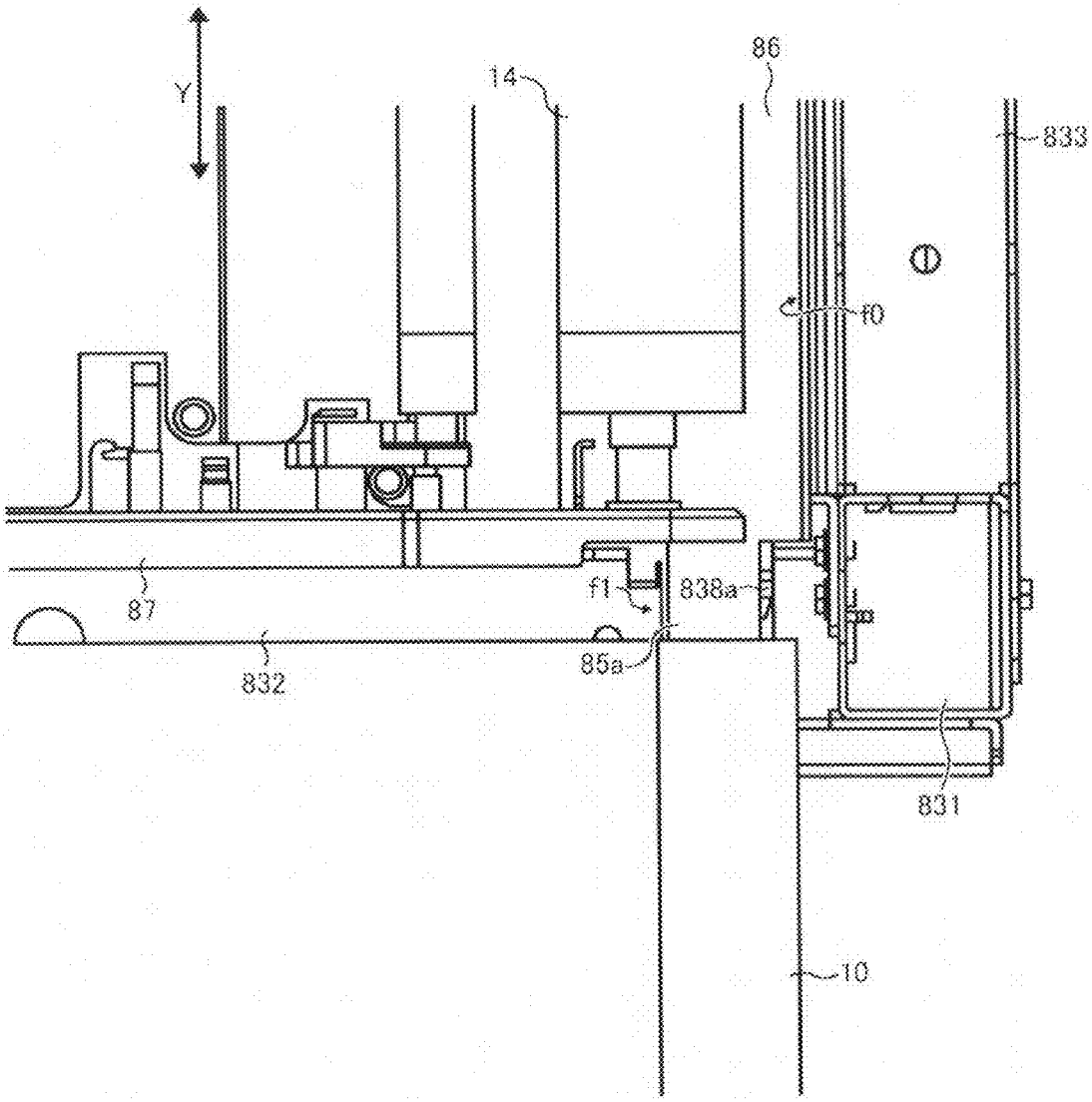
FIG. 10 illustrates a partial plan view before attaching the transfer belt from the right side mounting structure of the transfer unit in the chassis of FIG. 3.

In this case, the guide surface f1 and the vertical guide surface f2 are each formed as a surface extending backward as a mounting direction in winding the loosened transfer belt 10, and the guide surface f0 of the connecting side plate 86 is formed at a distal side of the connecting side plate 86 (see FIGS. 10 and 17). In particular, when a curved portion of the crank-angled cross section of the connecting side plate 86 is formed as the guide surface f1 having a curved R shape, the guide surface f1 functions to slidably contact the outer surface of the transfer belt and restricts shifting of the belt while suppressing abrasion.

Herein, as illustrated in FIG. 14, the vertical guide surface f2 of the left connecting side plate 89 and the planar guide member 85*b* can restrict shifting of the transfer belt 10 in the lateral direction X perpendicular to the pull-out direction Y. On the other hand, as illustrated in FIG. 7 by a broken line, the guide member 85*a* having a crank-angled cross section can prevent interference of the belt 10 with other members both in removing and mounting the transfer belt 10 while preventing shifting of the transfer belt 10 in the lateral direction X and the vertical direction Z.

Thus, portions of the transfer belt 10 opposed to the rollers 14, 15 are prevented from interfering with the surrounding members in either case of unit attachment or detachment due to the functions of guide members 85 and the connecting side plate 86. Specifically, because a pair of guide members 85*a*, 85*b* (or 85*dp*) is disposed opposite the pair or rollers 14, 15, excess shifting of the belt until the belt is wound around the rollers is prevented, so that the mounting operation becomes easier.

Thus, in either case of unit attachment or detachment, a pair of connecting side plates 86, 89 and the guide members 85*a*, 85*b* (or 85*dp*) at the frontal side can guide the belt 10 so that the outer circumferential surface of the belt 10 does not interfere with the surrounding members and the outer circumferential surface thereof is securely prevented from being damaged.

Figure 18B:
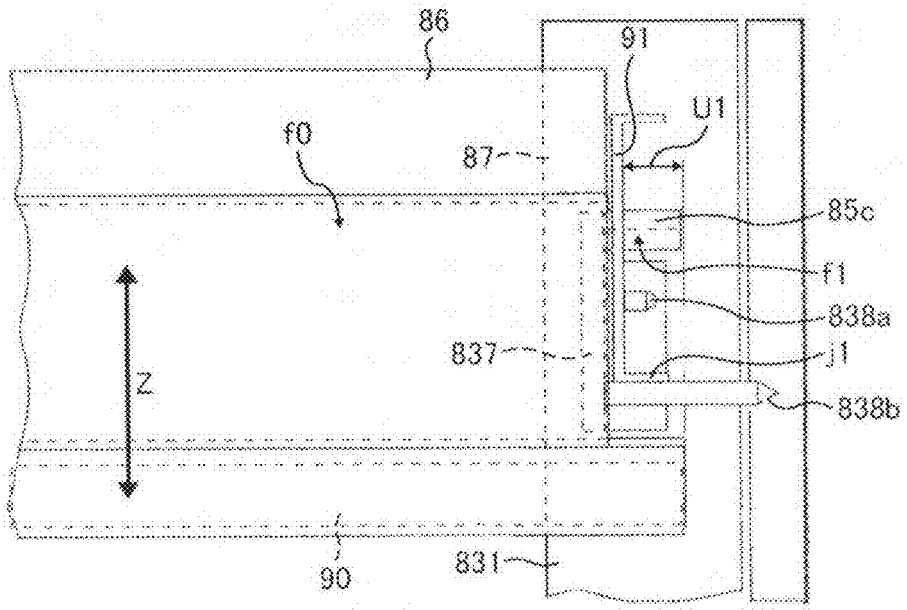

Namely, as illustrated in FIGS. 16, 18A, and 18B, a pair of guide members 85*a*, 85*b* (or 85*dp*) prevents the outer circumferential surface of the belt 10 from expanding in the horizontal direction when the transfer belt 10 is mounted. As a result, the belt mounting operation until a border of the belt transcends the front side plate 87 and is wound around the first and second rollers 14, 15 becomes easier.

Figure 11:
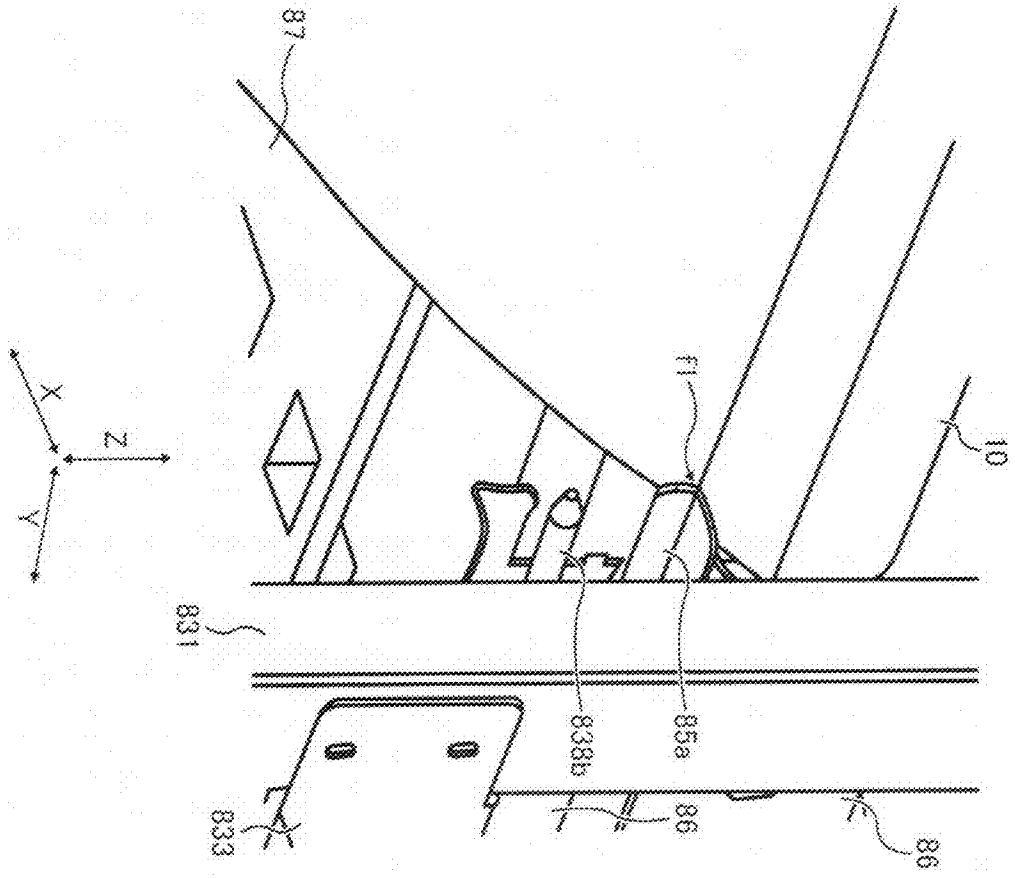
FIG. 11 illustrates a perspective partial view before attaching the transfer belt from the right side mounting structure of the transfer unit in the chassis of FIG. 3.

FIGS. 10 and 11 show that the once pulled-out transfer belt 10 is thereafter wound around the roller 14. Herein, as a positional relation, at around the roller 14 at one end, because the guide member 85*a* is projected to the most proximal direction in the transfer unit 5, the belt can be put on a leading end of the guide member 85*a*, so that the interference with the surrounding members can be securely prevented.

On the other hand, FIG. 17 shows a case in which the once pulled-out transfer belt 10 is wound on the left roller 15 using the movable guide plate 85*dp*. The transfer belt 10 moves along the vertical guide surface f2 of the movable guide plate 85*dp*. In this case, the transfer belt 10 is inserted to approach outward so that the transfer belt 10 does not interfere with the belt unit frame 80 at an inner side of the belt. Further, to prevent interference with the other parts locating outside, the transfer belt 10 is moved along the guide surface 12 and the inner guide surface f0 continuing from the movable guide plate 85*dp* and the left connecting side plate 89 in the distal side.

Thus, according to the first embodiment of the image forming apparatus, when a unit body of the transfer unit 5 is pulled out of the chassis A1 through the front opening 82 and then attached to the chassis A1, the outer circumferential surface of the belt is prevented from interfering with the other parts and components due to the guide members 85*a*, 85*b*, and the like. Moreover, attachment/detachment of the belt to the regular position P1 inside the chassis A1 can be performed easily.

More specifically, when the guide members 85*a*, 85*b* are pulled out to the position P2 together with the transfer unit 5, and thereafter, are returned to mount at the regular position P1, each guide member 85*a*, 85*b* guides the transfer belt 10 toward the pair of rollers 14, 15, and the winding of the transfer belt 10 is simplified.

Further, the guide members 85 are integrally formed with the right and left connecting side plates 86, 89 (positioning members) each serving to position the transfer unit 5 relative to the chassis A1. Thus, the guide members 85 are supported by the positioning members of the side of the chassis A1, the structure is not complicated compared to a case in which the guide members are disposed additionally.

Next, a description will be given of a second embodiment of the present invention.

As described above, the guide members 85*a*, 85*b* employed in the image forming apparatus are integrally mounted and supported to the proximal ends of the right and left connecting side plates 86, 89 that approach the vicinity of the front opening 82 of the chassis A1 (see FIGS. 3 and 24). A support structure of the second embodiment that is different from that of the first embodiment will be described referring to FIGS. 18B and 19.

The second embodiment according to the second embodiment includes a chassis A2 and a guide member 85*c* used as a support structure in the chassis A2 is different from the support structure in the first embodiment and other structures are similar. Therefore, a redundant description will be omitted.

The copier body 100 of the image forming apparatus includes the chassis A2 and a transfer unit 5 is disposed inside the chassis A2. A bottom end of the right connecting side plate 86 is connected to and supported by the right stay 833 (see for example FIG. 6) via the slide rail 90. The belt unit frame 80 of the transfer unit 5 joined together with the right and left connecting side plates 86 and 89 is therefore supported by the right and left stays 833. The transfer belt 10 disposed inside the chassis A2 is held in a posture of the unit attachment/detachment at a time of maintenance. Further, the transfer unit 5 is pulled out and moved proximally in the longitudinal direction of the first and second rollers 14, 15, and thereafter, the transfer belt 10 is held in a posture of the unit attachment/detachment at a time of mounting.

As illustrated in FIG. 19, an upper part of the connecting side plate 86 is disposed opposite the first roller 14, serving as a tension member, with a predetermined interval, a bottom part of the connecting side plate 86 is connected to the slide rail 90, and a middle part of the connecting side plate 86 is formed as a curved wall. The middle curved wall is formed to avoid interference with a positioning plate 836*a* that is formed integrally with the support pillar 831. As a result, when the transfer unit 5 is taken out and moved, and thereafter, moved to be mounted again, the connecting side plate 86 can be moved without interfering with the positioning plate 836*a* fixed to the support pillar 831.

The middle curved wall is projected forward and the bottom end 86*d* of the projected wall alone is projected by a distance U1. The middle curved wall is connected to and supported by the lateral stays 833 via the slide rail 90 (see FIGS. 7 and 12).

The positioning plate 836*a* protrudes toward the opening 82 from the support pillar 831 and includes the positioning pin 838*a*, the guide pin 838*b*, and a guide member 85*c* with the guide surface f1 having a crank-angled cross section, which protrudes forward. Herein, the guide member 85*c* is integrally formed with the positioning plate 836*a* that is integrally formed with the right support pillar 831 positioned outside the right connecting side plate 86, not with the right connecting side plate 86.

As such, the guide surface f1 having the crank-angled cross section of the guide member 85*c* is disposed at an upper middle side of the positioning plate 836*a*, so that the positioning plate 836*a* is prevented from contacting the outer circumference of the transfer belt 10.

Positioning slits to engage the guide member 85*c* and the positioning pin 838*a* are disposed on the right joint plate 91 covering the positioning plate 836*a* similarly to the first embodiment.

Further, as illustrated in FIG. 19, the guide pin 838*b* serves as a positioning member for the transfer unit 5 and the right joint plate 91 and supports the right joint plate 91 by contacting the bottom end of the right joint plate 91 when mounting the right joint plate 91 by moving it from the proximal side to the distal side in the figure. In this case, the guide pin 838*b* serving as a positioning regulator allows the positioning pin 838*a* and the guide member 85*c* to be inserted into the positioning slits. "sb" means a stopper bis.

Parts and components such as the connecting side plate, the positioning plate integrally formed with the left support pillar 831, and the positioning pins 838*a*, 838*b* disposed on the left side of the image forming apparatus are similarly, symmetrically formed as equivalents on the right side of the apparatus.

The guide member 85*c* according to the second embodiment is a sheet metal but may be formed of resins or die-cast alloy. The guide member 85*c* may be applied with fiber or a film.

Further, in the present embodiment, the guide member 85*c* is integrally formed with the positioning plate 836 that is a part of the body. Alternatively, however, the guide member 85*c* may be a separate member as long as it is a member disposed at an edge portion of the opening of the body. The guide member 85*c* may not be a member disposed on the body, but can be a member disposed at an edge of the front opening 82. For example, the guide member 85*c* may be formed as a frame member of an upper part of the tandem image forming device 20 such as a photoreceptor unit frame or a frame of the feeder of the sheet conveyance section near the bottom of the apparatus.

Next, a description will be given of a third embodiment of the present invention.

As described in the first embodiment, the guide members 85*a*, 85*b* disposed in the chassis A1 are each supported at a leading end of the connecting side plates 86, 89, respectively. The third embodiment is different from the first embodiment in the support structure of the guide member. Because structures other than the support structure embodied by the guide member 85*d* that a chassis A3 according to the third embodiment includes are the same as those in the first embodiment, redundant description will be omitted.

Figure 21:
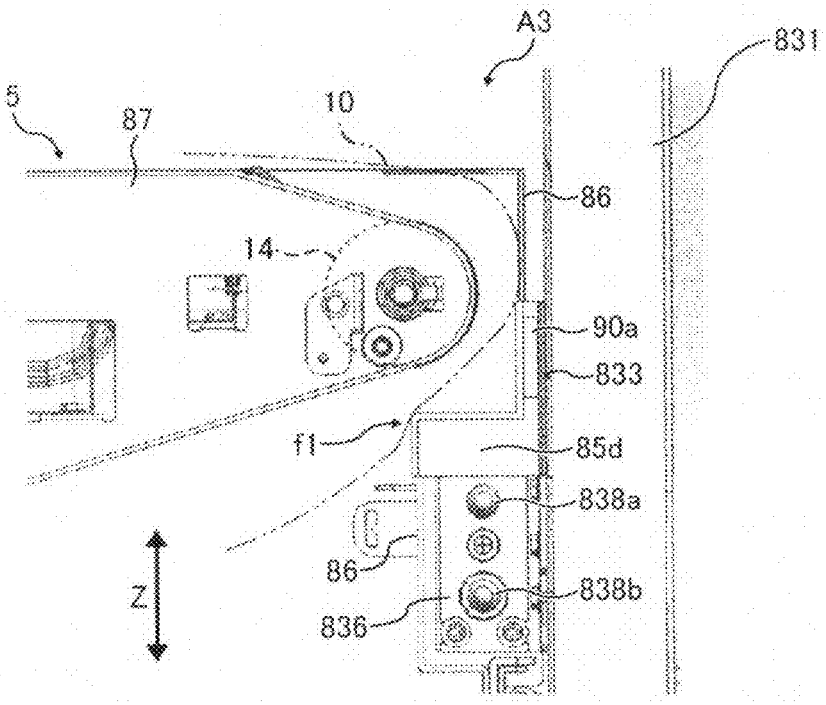
FIG. 21 illustrates a partial front view illustrating a support structure for a right portion of the transfer unit and the guide member used in the image forming apparatus according to yet another embodiment of the present invention.
Figure 22:
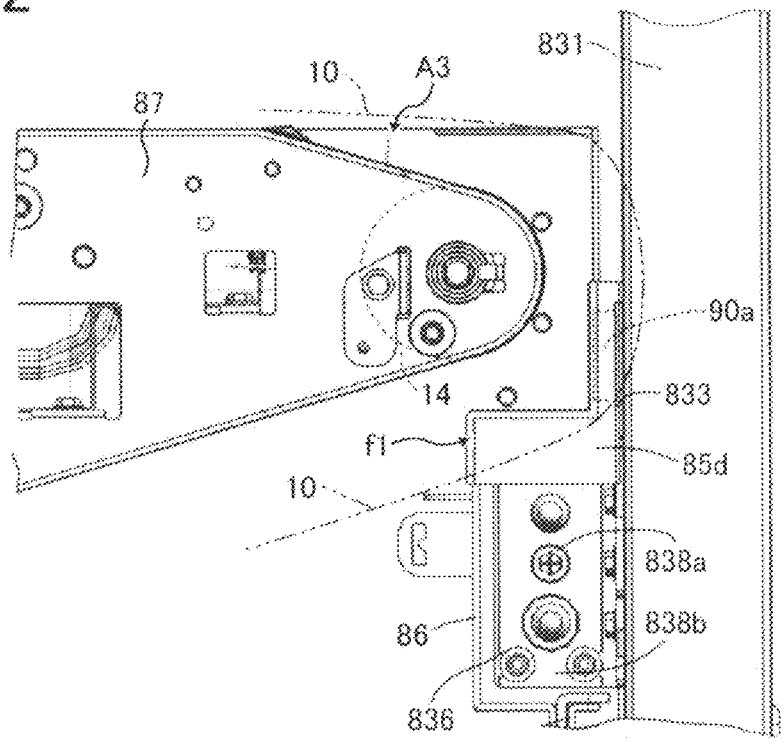
FIG. 22 illustrates a partial front view illustrating a status before winding the belt of the support structure for the guide member of FIG. 21.
Figure 23:
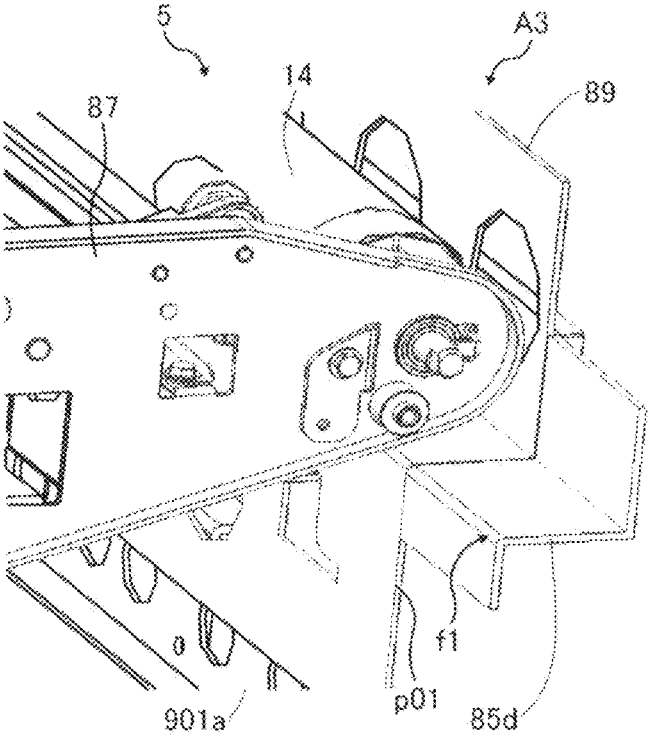
FIG. 23 illustrates a perspective partial view illustrating the support structure for the guide member of FIG. 21.

Herein, as illustrated in FIGS. 20, 21, and 22, the upper side wall of the connecting side plates 86, 89 disposed at the lateral ends of the transfer unit 5 inside the chassis A3 is connected to and supported by the lateral stays 833 via a slide rail 90*a*. Herein, the slide rail 90*a* includes a movable inner rail 901*a* that is integrally disposed on the upper side wall of the right connecting side plate 86. Further, the slide rail 90*a* includes a fixed outer rail 902*a* that is integrally mounted on the stay 833. Namely, the transfer unit 5 is movably supported in a proximal-distal direction Y relative to the fixed outer rail 902*a* of the outer frame 83. The guide member 85*d* integrated with a common front end p01 (see FIG. 23) of the movable inner rail 901*a* and the right connecting side plate 86 that are joined together such that a trailing end of the guide member 85*d* contacts the front end p01 and the proximal end of the guide member 85*d* protrudes forward. Thus, the guide member 85*d* is movably supported in the proximal direction of the roller axis.

With such a structure, as illustrated in FIG. 20, when the belt unit frame 80 of the transfer unit 5 is pulled out to the position P2, the movable inner rail 901*a* of the side of the belt unit frame 80 is pulled out to the pull-out position P2 simultaneously. In such a state, the guide member 85*d* moves along the belt moving direction being a roller mounting axis direction from the proximal side of the roller axis direction. In this position, the guide member 85*d* at the leading end of the movable inner rail 901*a* prevents an excessive shilling of the outer surface of the belt and guides mounting of the belt. With this structure, the outer surface of the belt is prevented from interfering with other parts around the transfer unit.

In each of the embodiments described above, a structure in which the belt unit frame 80 of the transfer unit 5 is pulled out to the pull-out position P2 is described. Alternatively to those examples, a case in which the belt unit frame 80 of the transfer unit 5 is not pulled out to the pull-out position P2 and is held directly below the regular position P1 will be described.

In this case, the transfer unit 5 positions at the same position as the regular position P1 in the posture of the belt conveyance and directly below the regular position P1 with a predetermined distance in the posture of the unit removal. In this case, the transfer unit 5 is held at the regular position P1 in the moving direction only by switching from the posture of the belt conveyance to the posture of the unit removal.

Now, the transfer belt 10 that is stretched on the belt unit frame 80 is disposed at the regular position P1, is switched to the posture of the unit removal, and is wound around three rollers 14, 15, and 16 (see FIG. 1). Then, the outer tension roller 17 alone contacting the outer surface of the belt (see FIG. 1) is removed and is pulled out along the roller axis direction.

Further, when pulling out the transfer belt 10 in the unit removal direction or returning to mount the transfer belt 10 from the proximal side in the roller axis direction, the guide surface f1 of the guide member 85*a* can guide the outer circumferential surface of the transfer belt 10 in the moving direction thereof.

Substantially similarly to the first embodiment, the pair of guide members 85 and the connecting side plate 86 can guide the transfer belt 10 or an endless belt not to interfere with other parts and components and prevent the outer circumferential surface thereof from being damaged, so that the attachment/detachment of the transfer belt 10 can be performed easily.

In the above description, the transfer belt 10 can be applied to a belt unit support device of the secondary transfer belt 24, which is also an endless belt (see FIG. 1), that sends a recording sheet to a sheet discharging unit.

In addition, the present invention may be applied to the image forming apparatus that conveys the sheet between the photoreceptor and the conveyance belt and the toner image on the photoreceptor to the sheet. Thus, the present embodiment includes at least a following aspect:

A conveyance belt, similar to the transfer belt 10, that is supported by a plurality of rollers such as the rollers 14, 15, and 16 and can be mounted from the proximal side in the roller axis direction, as can side plates (such as the front side plate 87 and the rear side plate 88) that support an end of the plurality of rollers. Further, the present embodiment can be applied to an image forming apparatus including guide members (such as guide members 85*a*, 85*b*) to guide the conveyance belt to mount to the plurality of rollers with the guide members contacting an outer surface of the conveyance belt.

As the image forming apparatus that includes belt unit support chassis A1 to A3 can obtain supportive effects of the chassis.

As to the image forming apparatus, a color copier has been described heretofore, but the present embodiment can be applied to printers, facsimile machines, and other types of image forming apparatuses.

As described above, the right and left connecting side plates 86, 89, and the guide members 85*a*, 85*b* may be separate members, but are formed integrally as a single member, such that the right connecting side plate 86 and the guide member 85*a* can be integrated.

Disposition of the rollers 14, 15 that support the belt 10 is not limited to the examples of embodiments. Without providing the outer tension roller 17 (see FIG. 1) that contacts the outer surface of the belt, the belt can be supported by rollers that contact an inner surface of the belt alone.

Further, the side plates 87, 88 to support one end of the plurality of rollers 14, 15 may be separately formed or integrally formed in combination with other members.

Because the guide members 85*a*, 85*b* each include a guide surface to contact an outer surface of the belt, the planar shape of the guide member serves to guide the belt in mounting, and the belt and the guide member contact via a planar surface. Then, compared to the point contact or line contact, it is sure that the belt can be prevented from being damaged.

The image forming apparatus further includes an image carrier on which a toner image is formed, and a belt serving as a transfer belt on which the toner image on the image carrier is transferred. Thus, when the present embodiment is applied to an apparatus including a transfer belt that can be mounted on the plurality of rollers, the belt can be prevented from damaged by that the outer surface of the belt contacts other parts or components when the transfer belt is to be mounted.

According to the present invention, when attaching the belt from the proximal side in the roller shaft direction relative to the plurality of rollers supported by the side plates, the belt is moved along the guide member for attachment, because the guide member prevents excess shifting of the upper surface of the belt and properly guides the movement of the belt. Thus, the upper surface of the belt is prevented from being interfered with by other parts around the transfer unit.

Preferred embodiments of the present invention have been described heretofore; however, the present invention is not limited to the described embodiments and various modifications are possible within the scope of claims unless explicitly limited in the description.

For example, the image forming apparatus to which the present embodiments of the invention may be applied is not limited to the types of the apparatuses as described above, but may be applied to any other types of image forming apparatuses. The present invention may be applied to an image forming apparatus such as a copier, a printer, a facsimile machine, and a multifunction apparatus having one or more capabilities of the above devices. The image forming apparatuses to which the present embodiment of the present invention is to be applied may be image forming apparatuses used for forming a predetermined image in biotechnology field. Effects described in the present embodiments are examples of preferred results of embodiments of the present invention and are not limited to what has been already described herein.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:
- a plurality of rollers;
- an endless belt mountable to the plurality of rollers from a proximal side of the image forming apparatus in an axial direction of the plurality of rollers;
- a first side plate to support one end of the plurality of rollers at the proximal side of the image forming apparatus in the axial direction; and
- a guide member, disposed at a more proximal side than the first side plate in the axial direction, to guide the belt to be mounted to the plurality of rollers with the guide member contacting an outer surface of the belt.

2. The image forming apparatus as claimed in claim 1, wherein the plurality of rollers includes a pair of rollers at opposed lateral ends thereof, and the guide member is disposed opposite one of the pair of rollers.

3. The image forming apparatus as claimed in claim 1, wherein the guide member is disposed opposite one of a pair of rollers separated maximally in the plurality of rollers.

4. The image forming apparatus as claimed in claim 1, further comprising:
- a second side plate to support another end of the plurality of rollers in the axial direction; and
- a connecting side plate connected to the second side plate and extending toward the proximal side of the image forming apparatus in the axial direction,
- wherein the guide member is supported by the connecting side plate.

5. The image forming apparatus as claimed in claim 4, further comprising:
- a belt unit; and
- a chassis housing the belt unit,
- wherein the belt unit comprises:
  - the endless belt;
  - the plurality of rollers;
  - the first side plate; and
  - the guide member,
  - wherein the belt unit is detachable from the chassis to the proximal side of the image forming apparatus in the axial direction.

6. The image forming apparatus as claimed in claim 5, further comprising a positioning member having a slit into which the guide member is inserted to position the belt unit relative to the chassis when the belt unit is mounted to the chassis.

7. The image forming apparatus as claimed in claim 6, wherein the belt unit shares the guide member as first positioning pin, the chassis includes a second positioning pin, and the positioning member includes a first positioning slit into which the guide member serving as the first positioning pin are inserted and a second positioning slit into which the second positioning pin is inserted.

8. The image forming apparatus as claimed in claim 7, wherein the chassis includes the second positioning pin and an engagement pin in the vicinity of the second positioning pin, and a bottom end portion of the positioning member abuts an upper end surface of the engagement pin.

9. The image forming apparatus as claimed in claim 5, further comprising a slide rail that supports the belt unit on the chassis.

10. The image forming apparatus as claimed in claim 9, wherein the guide member and the slide rail form a single unit.

11. The image forming apparatus as claimed in claim 5, wherein the belt unit comprises the endless belt, the plurality of rollers, and the first side plate,
- the chassis has an opening through which the belt unit is drawable from the chassis to the proximal side of the image forming apparatus in the axial direction, and
- the chassis supports the guide member.

12. The image forming apparatus as claimed in claim 11, further comprising a support member disposed facing the opening of the chassis to support the guide member.

13. The image forming apparatus as described in claim 6, wherein the guide member and the positioning member form a single unit to position the belt unit relative to the chassis.

14. The image forming apparatus as claimed in claim 1, wherein the guide member is movable to the proximal side of the image forming apparatus in the roller axis direction.

15. The image forming apparatus as claimed in claim 1, wherein each of the guide member includes a guide surface that contacts the belt.

16. The image forming apparatus as claimed in claim 15, wherein the guide surface is made of resin.

17. The image forming apparatus as claimed in claim 15, wherein the guide surface is implanted with fiber.

18. The image forming apparatus as claimed in claim 1, wherein the guide member includes a curved projecting portion that projects toward the belt.

19. The image forming apparatus as claimed in claim 1, further comprising an image carrier to bear a toner image thereon,
- wherein the toner image on the image carrier is transferrable onto the belt.

20. An image forming apparatus comprising:

a plurality of rollers;

an endless belt mountable to the plurality of rollers;

a side plate to support the plurality of rollers; and a guide member having a guide surface that extends from a position of the side plate toward a front side of the image forming apparatus in an axial direction of the plurality of rollers, wherein the guide surface contacts an outer surface of the endless belt to guide the endless belt to be mounted to the plurality of rollers.

21. The image forming apparatus according to claim 20, wherein the guide surface prevents the endless belt from expanding.

22. The image forming apparatus according to claim 20, wherein the guide surface faces a lateral side of the side plate.

23. The image forming apparatus according to claim 22, wherein the guide surface prevents the endless belt from expanding laterally.

24. An image forming apparatus comprising:

a chassis; and a transfer unit movable to a puliout position in a moving direction relative to the chassis, the transfer unit including:

a plurality of rollers;

an endless belt mountable to the plurality of rollers;

a front side plate; and a guide member that includes a guide surface extends from a position of the front side plate toward a front side in the moving direction, wherein the guide member guides the endless belt to be mounted to the plurality of rollers when the transfer unit is in the pull-out position, wherein a gap is formed between the guide surface and the front side plate, and wherein a part of the belt passes through the gap when the belt is mounted to the plurality of rollers.

25. The image forming apparatus according to claim 24, wherein the transfer unit includes a rear side plate and a connecting side plate connected to the rear side plate, and wherein the guide member is disposed at a front end of the connecting side plate.

26. The image forming apparatus according to claim 25, wherein the connecting side plate is opposed to the one of the plurality of rollers via the endless belt.

27. The image forming apparatus according to claim 25, wherein the connecting side plate and guide member are integrally formed.

28. The image forming apparatus according to claim 24, wherein a position of the guide surface is opposite the outer surface of the belt when the part of the belt passes through the gap.

* * * * *